US009617816B1

(12) United States Patent
Sullivan

(10) Patent No.: US 9,617,816 B1
(45) Date of Patent: Apr. 11, 2017

(54) FRACTURING BALL RETRIEVAL DEVICE AND METHOD

(71) Applicant: Bakken Ball Retrieval, LLC, Minot, ND (US)

(72) Inventor: Cary James Sullivan, Hibbing, MN (US)

(73) Assignee: BAKKEN BALL RETRIEVAL, LLC, Minot, ND (US)

( * ) Notice: Subject to any disclaimer, the term of this patent is extended or adjusted under 35 U.S.C. 154(b) by 0 days.

(21) Appl. No.: 14/864,407

(22) Filed: Sep. 24, 2015

(51) Int. Cl.
*E21B 31/00* (2006.01)
*E21B 33/12* (2006.01)
*E21B 43/08* (2006.01)

(52) U.S. Cl.
CPC ..... *E21B 31/00* (2013.01); *E21B 33/12* (2013.01); *E21B 43/08* (2013.01)

(58) Field of Classification Search
CPC ..... E21B 23/00; E21B 31/00; E21B 33/12; E21B 43/08
See application file for complete search history.

(56) References Cited

U.S. PATENT DOCUMENTS 4,420,040 A 12/1983 Arbasak et al.
5,127,472 A 7/1992 Watson et al.
5,244,044 A * 9/1993 Henderson ..... E21B 23/04 166/238
6,216,785 B1 * 4/2001 Achee, Jr. ..... E21B 33/124 166/278
6,341,653 B1 * 1/2002 Firmaniuk ..... E21B 33/134 166/135
7,530,400 B2 * 5/2009 Telfer ..... E21B 23/00 166/193
8,118,101 B2 * 2/2012 Nelson ..... E21B 23/04 166/318
8,839,855 B1 * 9/2014 McClinton ..... E21B 33/1292 166/135
2009/0008098 A1 1/2009 Barbee, Jr.
2012/0073827 A1 * 3/2012 Kenyon ..... E21B 34/107 166/373
2012/0199349 A1 * 8/2012 Themig ..... E21B 34/14 166/285

(Continued)

OTHER PUBLICATIONS

Co-pending U.S. Appl. No. 14/864,459, filed Sep. 24, 2015, entitled "Fracturing Ball Retrieval Device and Method".

(Continued)

*Primary Examiner* — Michael Wills, III
(74) *Attorney, Agent, or Firm* — David W. Carstens; Sudhakar V. Allada; Carstens & Cahoon, LLP

(57) ABSTRACT

A method and system for retrieving a fracturing ball in a wellbore casing. The system includes a wellbore retrieval tool comprising a tool body that is inserted into and transported along the wellbore casing. The tool is sized and configured to trap and hold the fracturing ball. When a hydraulic lock happens in the wellbore casing, the retrieval tool is lowered in a vertical section and the ball is flowed back along a horizontal section and captured by a trap in the retrieval tool. The retrieval tool may also be run in conjunction with a setting tool with a ball-in-place fracturing plug. In case of the hydraulic lock, the injection is tested following perforation with the retrieval tool still a location proximal to the ball, and the ball is immediately retrieved.

29 Claims, 22 Drawing Sheets

(56) References Cited

U.S. PATENT DOCUMENTS

| | | | | |
|---|---|---|---|---|
| 2014/0318815 | A1* | 10/2014 | Merron | E21B 34/14 166/386 |
| 2015/0252643 | A1* | 9/2015 | Mailand | E21B 43/119 166/250.01 |
| 2015/0369010 | A1* | 12/2015 | Themig | E21B 34/14 166/305.1 |

OTHER PUBLICATIONS

ISAUS, International Search Report and Written Opinion for PCT/US2016/053345, dated Nov. 3, 2016.
ISAUS, International Search Report and Written Opinion for PCT/US2016/053366, dated Dec. 2, 2016.

* cited by examiner

FRACTURING BALL RETRIEVAL DEVICE AND METHOD

BACKGROUND OF THE INVENTION

Technical Field

The present invention relates generally to a device, method, and system for retrieving fracturing balls used in the process of hydraulic fracturing. More particularly, the present invention relates to a fracturing ball retrieval device, method and system.

Description of Related Art

The process of hydraulic fracturing can be used to stimulate a well to maximize the extraction of natural gas or oil. This process can utilize the injection of high-pressure fluids and proppant into the wellbore to create and hold open fractures in the rock. In some processes, a horizontal wellbore is utilized. The wellbore can be drilled thousands of feet deep vertically and thousands more feet horizontally. The horizontal section can be completed and fractured in sections from the toe of the wellbore (or the far end of the horizontal run) back to the heel of the wellbore (where the wellbore becomes vertical and starts to rise towards the surface). Two methods for completing and fracturing the horizontal wellbore are known as "plug and perf" and "sliding sleeve." Both methods can utilize frac balls, and in some cases, these frac balls need, or are desired, to be removed.

In the "plug and perf" method, once the wellbore is drilled, a wireline crew can be utilized for the purpose of lowering tools and explosives by means of a crane and large winch truck or wireline unit with thousands of feet of cable. The wireline crew can send down a tool string with a perforating gun to fire off and create perforations in the toe section of the wellbore. The wireline crew can then remove the gun and inspect it to make sure it fired properly to create holes in the wellbore casing and cracks in the formation in that section of the well.

If the guns fired properly, then a fracturing crew can be utilized for the purpose of handling fluids and controlling pressure in the wellbore. The fracturing crew can pump proppant into the wellbore to fill and expand (fracture) the cracks formed by the perforating gun.

The wireline crew can then send down a tool string with a perforating gun and a plug on the end. The wireline crew can set the plug just outside the first fractured section. The plug can be designed to allow fluid and pressure to pass through until a frac ball is pumped down and seated in the plug to isolate the section. This fluid and pressure pass-through feature can be important because the hydraulic use of fluid and pressure can be critical to moving things through the wellbore and in forming the wellbore, and isolating a section removes that space from fluid movement and pressure operations.

On the same trip after setting the plug, the wireline crew can fire the perforating guns to fracture the subsequent section. The guns can then be pulled out and inspected to insure proper firing. If the guns fired properly, then a frac ball can be pumped down to seat inside the plug and isolate the previous section. This process can be repeated for each subsequent section. When the entire wellbore is formed, the balls and plugs can be drilled out to start production.

In an attempt to save time and fluid usage, the frac ball can be placed inside the plug prior to running the tool string with the perforating guns and the plug down the wellbore. The plug can then be set with the frac ball already seated, which is known as "ball-in-place," and the guns can then be fired on the same run. However, this can be considered risky and is often not done because isolating a section can prevent fluid and pressure movement through the isolated section. If ball-in-place is used and the guns don't fire properly, a hydraulic lockout can occur. The proper firing of the guns can be necessary to create perforations in the section of rock to prevent lockout after isolating a section. These perforations can create space for fluid and pressure to move into, which can be necessary to maintain movement of fluid and tools in the wellbore after a previous section is isolated. If these perforations are not formed, it can be desired or necessary to regain access to the isolated section. However, the seated frac balls can prevent access.

When a wellbore is hydraulically locked, costly and time-consuming measures often must be taken to regain fluid movement capabilities, such as electrical tractor conveyance methods and rigid tubing conveyance methods. Another costly and time-consuming measure that can be used is flowback, whereby surface lines can be opened to allow fluid to return to the surface from downhole pressure. Flowback volumes and rates can be limited by equipment and safety requirements and the possibility of natural gas, hydrogen sulfide, petroleum or chemicals returning to the surface can require substantial safety precautions. Using flow back to return seated frac balls from a plug to the surface can sometimes be difficult as a high rate of flow for an extended period of time can be required, or sometimes not practically obtainable. Wellbore sand or other materials may be too heavy or difficult to return to the surface. Flowback can also be used to pull a frac ball out of a plug partially, but it can re-seat itself and can cause lockout again. As such, flowback operations can require days and thousands of barrels of fluid to get enough access to the zone to continue operations. Flowback can also require substantial disposal requirements.

Gun misfires are common enough that it is often considered not feasible to take this risk. Therefore, ball-in-place runs are often not done and guns are pulled out and inspected before pumping down and seating a frac ball to isolate a section. Current methods for removing the frac ball can be considered inadequate to compensate for the risk of making ball-in-place runs because they can require a lot of time, special and expensive equipment, fluid usage, safety issues, and thus great expense.

Even when a gun fires properly and a ball is pumped down and set to isolate a section, lockouts can also occur with certain formation difficulties in the rock that prevent proper injection of fluid. In such a case, it can also be necessary or desired to remove a seated frac ball from an isolated section to regain hydraulic control of the wellbore.

Another way a lockout can occur is with "screen-outs" that can be caused by the wellbore becoming clogged by proppant and sand or can be caused otherwise where the formation at the perforations are not capable of accommodating additional fluid injection. The fracturing crew may have to utilize flowback to clear out the wellbore or remove some of the proppant in formation. In such a case, it can also be necessary or desired to remove a seated frac ball from an isolated section to regain hydraulic control of the wellbore.

The "sliding sleeve" method also possess the risk of screen out or improper sliding and opening of the sleeves, and could also benefit from the effective and efficient removal of fracturing balls.

SUMMARY OF THE INVENTION

It has been recognized that it would be advantageous to develop a frac ball retrieval device, method, and system for effectively and efficiently retrieving frac balls. It has further been recognized that it would be advantageous to retrieve frac balls deep within the wellbore more proximate to the location of the frac ball in order to minimize the amount of flowback needed. It has further been recognized that it would be advantageous to develop a method and system for more efficiently completing and fracturing stages in a wellbore by utilizing an effective frac ball retrieval device.

The invention provides for a frac ball retrieval device having a tool body that can be configured to be transported through a wellbore casing, a trap configured to retrieve at least one frac ball situated within the wellbore casing, and a means for transporting the tool body through the wellbore casing for retrieving the frac ball at a location within the wellbore. The tool body can be transported using a wireline. The frac ball retrieval device can have an adapter for connecting the tool body to the wireline or to a tool string of a wireline. The frac ball retrieval device can also have an adapter for connecting the tool body to a gun string of the wireline.

The tool body can be configured to allow fluid passage through the tool body. The tool body can have a screen that is configured for receiving the frac ball flowing into the tool body and limiting fluid passage through the tool body upon receipt of the frac ball.

The trap can have a channeling apparatus for directing the frac ball flowing into the tool body into a trap opening configured to allow passage of the frac ball though the trap and inside the tool body.

The frac ball retrieval device can also have at least one trap fluid port configured to direct a trapped frac ball away from the trap opening for preventing escape of the frac ball.

The frac ball retrieval device can have a guide for positioning the tool body within the wellbore. The guide can also be configured for directing the frac ball towards the trap.

The frac ball retrieval device can be configured for use in a wellbore having a vertical run and a horizontal run. The vertical run can have a surface end and a deep end. The horizontal run can have a heel, where it extends from the deep end of the vertical run, and a toe at the other or far end of the horizontal run. The frac ball retrieval device can have a means for transporting the trap through the wellbore for retrieving the frac ball at a location proximate to the heel of the horizontal run.

The frac ball retrieval device can have a means for transporting the trap through the wellbore for retrieving the frac ball at a location within the horizontal run of the wellbore. The frac ball retrieval device can also have a means for transporting the trap through the wellbore for retrieving the frac ball at a location proximate to the location of the situated frac ball.

The invention further provides for a method for retrieving a frac ball situated in a wellbore, by transporting a frac ball trap down a wellbore, flowing back the wellbore so that the situated frac ball flows backwards towards the frac ball trap, trapping the frac ball in the frac ball trap. Then, the method can provide for retracting the frac ball trap and frac ball out of the wellbore. The method can retrieve a ball from a perforation plug. The method can also retrieve a ball from a ball-actuated sliding sleeve.

The invention further provides for a system for completing fracturing stages in a wellbore, having at least one plug and perf run for plugging and isolating a previously fractured stage and perforating a subsequent stage, wherein a tool string having a perforating gun, a plug setter tool, and a ball-in-place plug is run down the wellbore, and wherein the ball-in-place plug is set to isolate the previously fractured stage, and wherein the perforating gun is fired to perforate the subsequent stage; and at least one ball retrieval for retrieving a frac ball from a set ball-in-place plug during a lockout condition, wherein a ball-retrieval tool is run down the wellbore as far as the lockout condition will allow, and wherein flowback of the wellbore is conducted so that the frac ball flows backwards towards the ball-retrieval tool, and wherein the frac ball is trapped in the ball-retrieval tool to alleviate the lockout condition. The ball-retrieval tool can be part of a tool string with a perforating gun, and the perforating gun can be fired after ball retrieval. The ball-retrieval tool can be part of a tool string in the plug and perf run, and ball retrieval can occur during the plug and perf run.

The invention also provides for a wellbore retrieval device having a tool body that can be configured to be transported through a wellbore, a trap configured to retrieve an object situated within the wellbore, and a means for transporting the tool body through the wellbore for retrieving the object at a location within the wellbore.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION OF THE INVENTION

Figure 1:
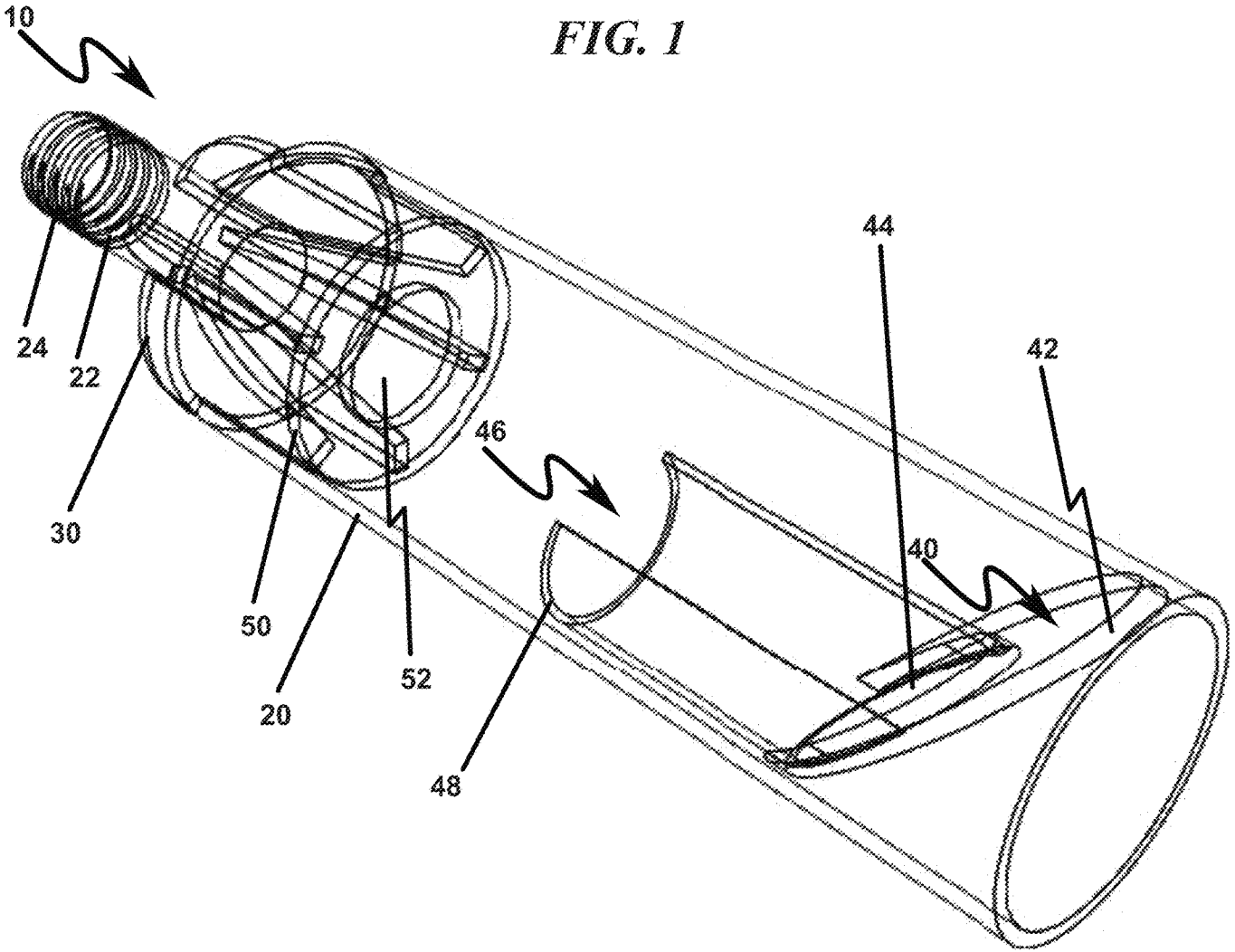
FIG. 1 shows a perspective view of a frac ball retrieval device in accordance with an exemplary embodiment of the present invention with a transparent outer surface so that the inner elements may be viewed.

While this invention has been particularly shown and described with reference to preferred embodiments, it will be understood by those skilled in the art that various changes in form and detail may be made therein without departing from the spirit and scope of the invention. The inventors expect skilled artisans to employ such variations as appropriate, and the inventors intend the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

It should be noted that the terms "wellbore" and "wellbore casing" may be used interchangeably to indicate a casing installed in a wellbore. It should be noted that the terms "frac ball" and "fracturing ball" may be used interchangeably to define a ball used to isolate a stage. It should be noted that the terms "frac ball retrieval device" and "wellbore retrieval tool" may be used interchangeably to define an exemplary embodiment tool or a device used to retrieve an object or a fracturing ball from a wellbore casing. It should be noted that the term "upstream" refers to a direction towards a heel end of the wellbore casing or a production direction of the wellbore casing. It should be noted that the term "downstream" refers to a direction towards a toe end of the wellbore casing or an injection direction of the wellbore casing.

As illustrated in the Figures, the invention provides for a frac ball retrieval device (wellbore retrieval tool), indicated generally at 10, having a tool body 20 configured to be transported through a wellbore, a trap 40 configured to retrieve at least one frac ball 12 situated within the wellbore, and a means for transporting the tool body through the wellbore for retrieving the frac ball at a location within the wellbore.

The device 10, as shown in FIG. 1, can be configured to be transported throughout a wellbore. The device can be configured to be generally cylindrical in shape with a diameter less than the diameter of the wellbore. In one embodiment, as shown in FIG. 1, the tool body 20 can be cylindrical in shape with a diameter less than the diameter of the wellbore.

The device 10 can also be configured for transportation throughout the wellbore such that snagging on imperfections in the wellbore edges are prevented. For example, the tool body 20 can be made cylindrical and have smooth, tapered, or curved implements to redirect the device away from or around such imperfections.

In one embodiment, as shown in FIG. 1, the device can have curved fins 30 to help guide the device around imperfections in the wellbore. The fins can also be tapered. Multiple fins can be configured to provide strength to the device and allow fluid to pass between them. In the embodiment shown in FIG. 1, the fins are secured to the adapter 22, secured to the tool body 20, and secured to and provide a base for the screen 50.

The means for transporting the frac ball retrieval device 10 can be a wireline (not shown). The tool body 20 can have an adapter 22 for attaching to the wireline. The adapter can be threaded 24 to attach to fittings or couplings typically used in wireline operations. The adapter can also be configured to attach to or made part of a tool string (see FIG. 14) that is on the wireline. The adapter can also be configured to attach to a gun string (see FIG. 18) on the wireline.

The frac ball retrieval device 10 can be configured for use in a wellbore having a vertical run and a horizontal run. In such a wellbore, the vertical run can have a surface end beginning at the surface of the wellbore, which can extend thousands of feet downhole essentially vertically down through the rock bed. The vertical run can have a deep end where the wellbore bends into the beginning of the horizontal run. This location is sometimes referred to as the heel. The horizontal run can extend thousands more feet essentially horizontally from the heel downhole to the location known as the toe at the far end of the horizontal run.

The frac ball retrieval device 10 can have a means for transporting the trap 40 through the wellbore for retrieving a restriction element such as a frac ball at a location within the horizontal run of the wellbore. The tool body 20 and trap 40 can be delivered to a location within the wellbore that is proximate to the location of the situated restriction element. When retrieving a restriction element, it can be beneficial to transport the device as near to the situated restriction element as is possible or practical. This can reduce the amount of flowback that is necessary to flow the restriction element back towards the trap.

However, in certain conditions, it can be impractical to transport the tool body 20 and trap 40 all the way to the situated restriction element. Nevertheless, it can be beneficial to retrieve the restriction element as close to the situated restriction element as the conditions will allow.

For example, in a lockout condition of a wellbore with vertical and horizontal runs, it may not be safe or practical to inject fluids to push the tool body 20 and trap 40 through the horizontal run. However, the frac ball retrieval device 10 can have a means for transporting the trap through the wellbore for retrieving the restriction element at a location proximate to the heel of the horizontal run. For example, the tool body can be configured to utilize gravity to pull it through the vertical run of the wellbore. The device can be increased in weight to increase the downward force from the pull of gravity.

In addition, the tool body 20 of the frac ball retrieval device 10 can be configured to allow fluid passage through the tool body. This can decrease the fluid resistance against the tool body as it moves through the wellbore. This can also allow the momentum from the transport forces to carry the device further into or past the heel, which may be particularly important in a lockout condition. The tool body 20 can be configured to allow ample fluid passage to reduce resistance during this downward transport. This can allow the momentum from the transport forces to carry the device 10 further into or past the heel. For example, as shown in FIG. 1, the device is configured with a streamlined shape for moving through the fluid efficiently, reducing the likelihood of snagging on the wellbore, and with ample avenues for fluid to pass through the device to lessen the force of fluid resistance. The device can be further configured to accomplish the desired fluid-movements to control the specific fluid hydraulic forces against the tool. In some configurations larger passages can be utilized to create less resistance. In other configurations, smaller passages can be utilized to create greater force, which can be helpful for moving the device in the direction of fluid movement.

The frac ball retrieval device 10 can also have a screen 50 within the tool body 20 wherein the screen is configured for receiving the restriction element flowing into the tool body and limiting fluid passage through the tool body upon receipt of the frac ball. In one embodiment, a hole or opening 52 in a washer-like screen can have a smaller diameter than the situated frac ball. During flowback operations to flow the ball back towards the trap 40, the fluid in the wellbore can be flowed backwards through the screen. When the restriction element enters the trap, the fluid flowing through the hole of the screen can pull the restriction element so that it lodges into the hole. This can increase the fluid resistance by diverting the fluid being flowed back elsewhere. In one embodiment, the fluid is diverted around the outside of the tool body. This event can cause a change in tension or hanging weight on the wireline that can be detectable and can indicate that the restriction element has been caught in the trap. The restriction element may be a fracturing ball or any element that provides a restriction in the wellbore. The restriction element may be shaped as a ball, sphere or cylinder.

Figure 2:
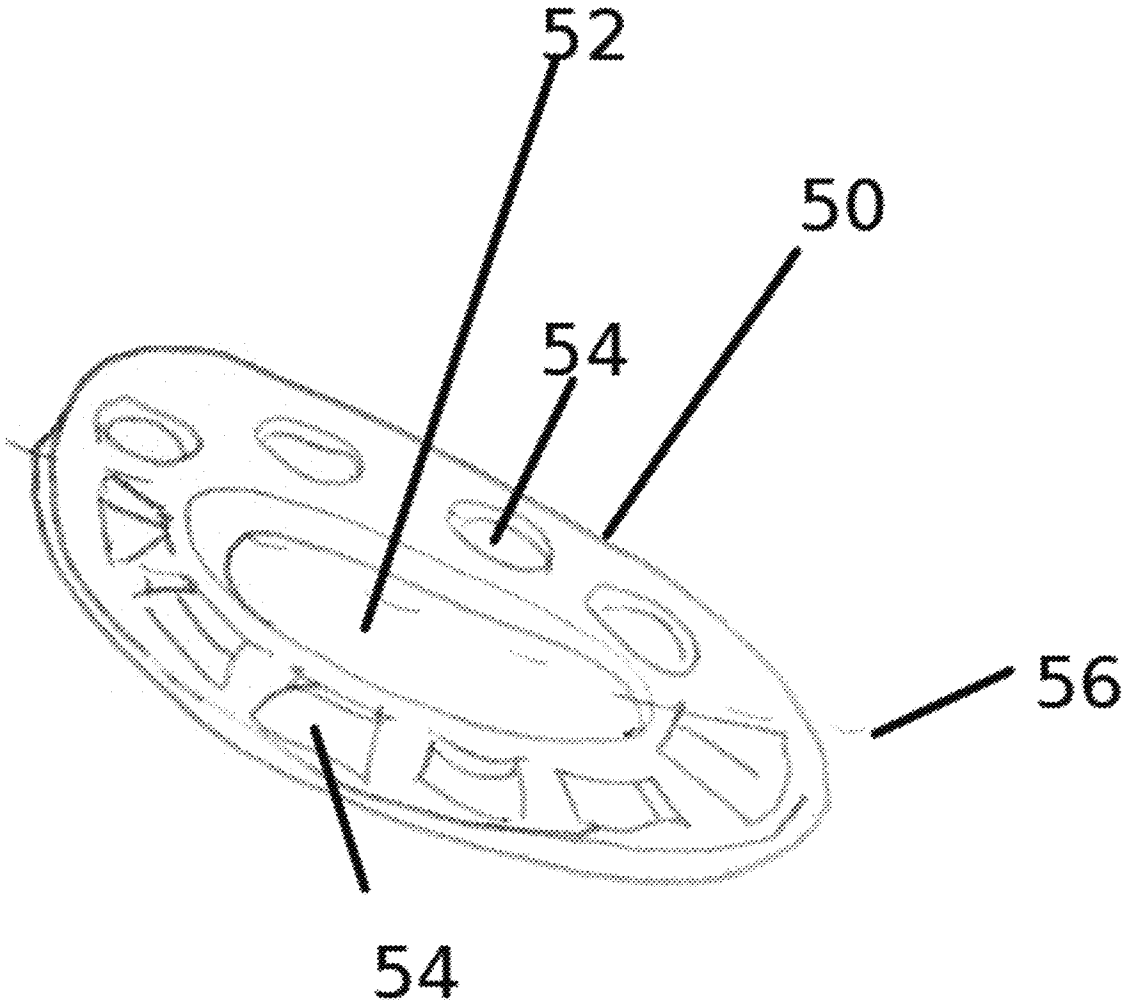
FIG. 2 shows a perspective view of an alternative screen having small fluid ports that can be used in a frac ball retrieval device in accordance with another exemplary embodiment of the present invention.

FIG. 2 shows an alternative screen design that can lessen the diversion of fluid to the outside of the device. This design incorporates small fluid ports 54 in the screen. This design can still provide for a detectable reading at the surface, but still allow some fluid movement through the tool body 20. The dashed line 56 is used to indicate on either side two different styles of small fluid ports 54 that could be used. Allowing fluid to keep moving through the tool can allow for better movement through the wellbore, or for multiple balls to be caught using multiple screens and/or baffles.

The trap, indicated generally at 40, of the frac ball retrieval device 10 can have a channeling apparatus (also referred to as "angled ramp") 42 for directing the restriction element 0412 (see FIG. 4A) flowing into the tool body 20 into a trap opening 44 configured to allow passage of the frac ball though the trap and inside the tool body.

In the embodiment shown in FIG. 1, the trap can be an angled ramp 42 in the tool body 20 to guide a restriction element 0412 (see FIG. 4A) flowing into the tool body towards the trap opening 44. The trap opening has a diameter that is larger than the diameter of the restriction element. The trap opening can be formed by a chute 48 forming a channel 46 that the frac ball can pass through to become trapped into the tool body.

Figure 5:
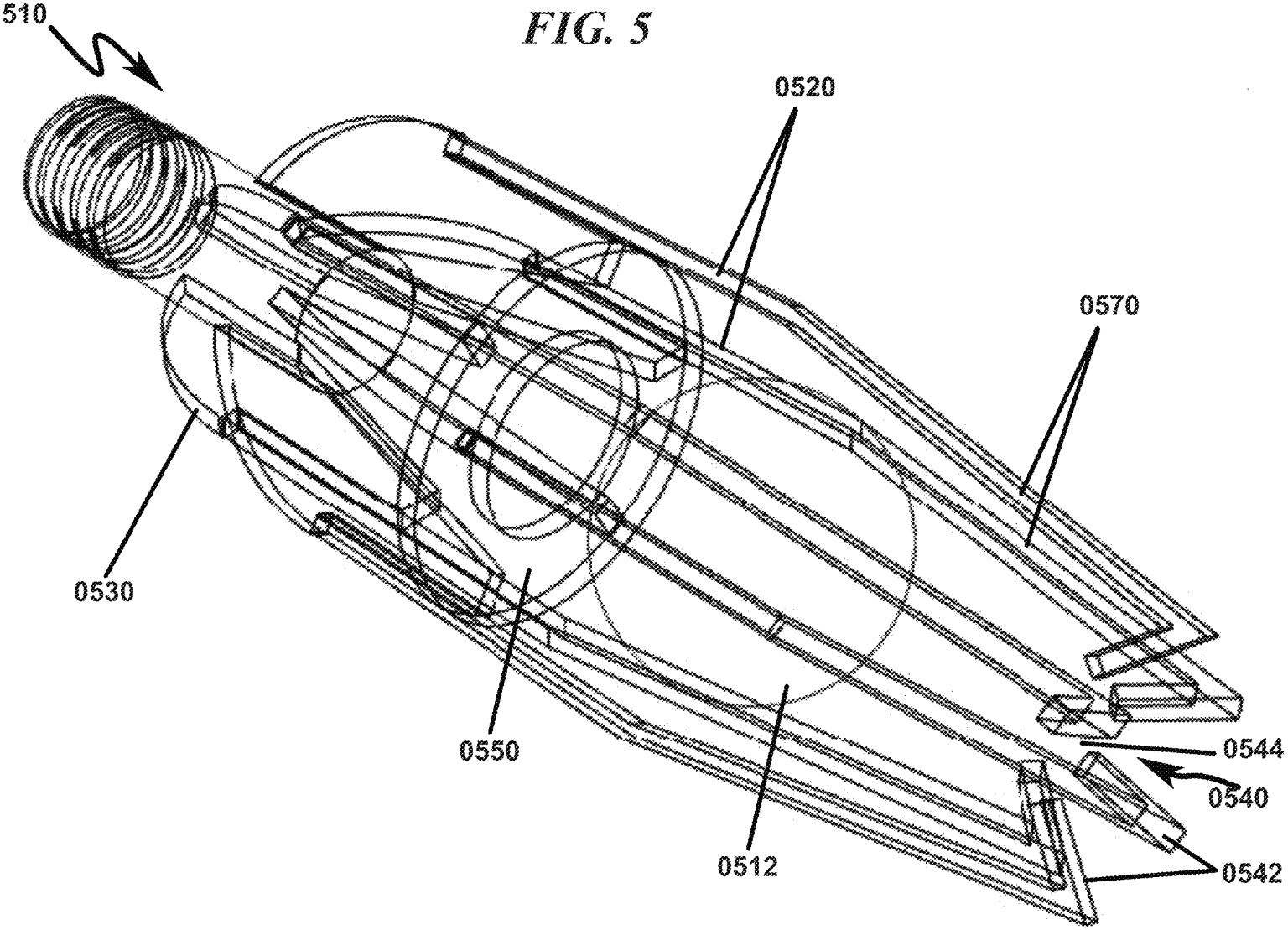
FIG. 5 shows a perspective view of another embodiment of a wellbore retrieval device in accordance with the invention with a frac ball trapped within the tool body and a trap having tension arms.
Figure 9:
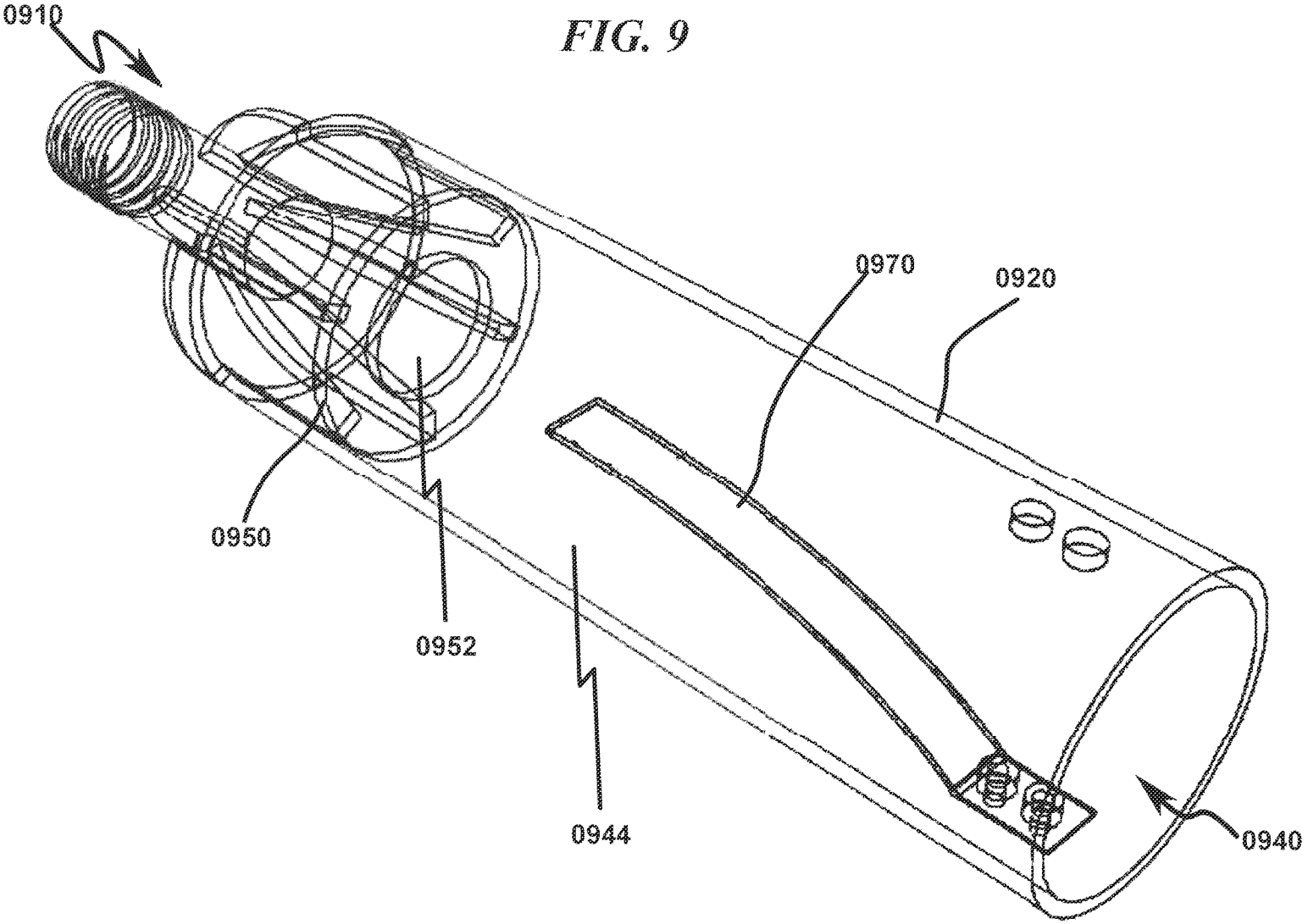
FIG. 9 shows a perspective view of another embodiment of a frac ball retrieval device in accordance with the invention with a transparent outer surface for viewing a trap having a tension arm.

In the embodiments shown in FIG. 5 and FIG. 9, the trap can have a trap opening that has a diameter that is initially smaller than the diameter of the frac ball, or a closed position. This can prevent the balls from escaping the trap. However, these embodiments can make use of a tension arm so that the force of the ball flowing back into the trap expands the diameter of the trap opening formed by one or more spring arms.

The frac ball retrieval device 10 can also have at least one trap fluid port 60 configured to direct a trapped frac ball away from the trap opening 44 for preventing escape of the frac ball. In the embodiment shown in FIG. 1, the trap opening has a chute 48 with a channel 46 extending from the trap opening into the tool body 20. The chute in this embodiment has a trap fluid port, indicated generally at 60, along it for passage of fluid movement downhole of the channel 46.

Figure 3:
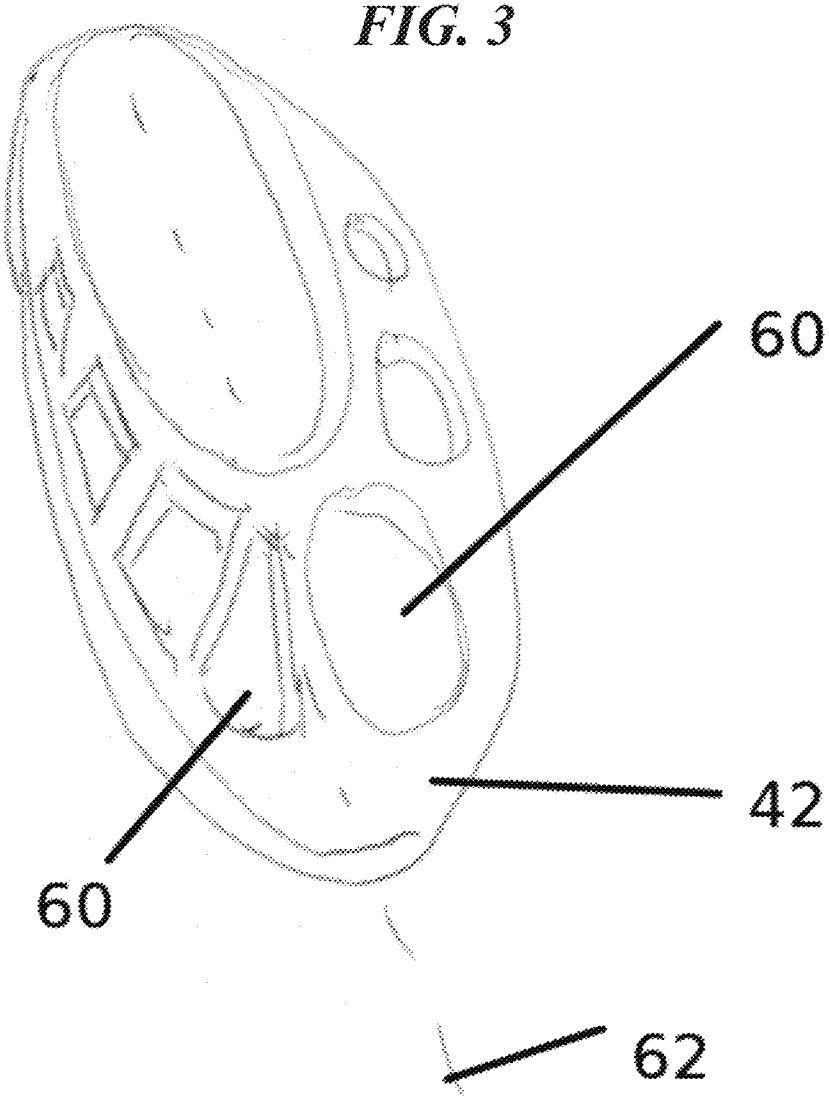
FIG. 3 shows a perspective view of an alternative channeling apparatus having trap fluid ports that can be used in a frac ball retrieval device in accordance with another exemplary embodiment of the present invention.

FIG. 3 shows an alternative design for an angled ramp 42 with trap fluid ports 60 in the angled ramp. The trap fluid ports in the angled ramp can also allow for fluid movement below the end of the channel 46. The dashed line 62 is used to indicate on either side two different styles of trap fluid ports that could be used.

The trap fluid ports 60 can be configured so that when the tool body 20 is retracted out of the wellbore, the fluid movement passing through the tool body guides the ball away from the channel 46 and towards the trap fluid ports near the base of the angled ramp 42.

The trap can also be configured with other trap means. For example, magnets could be incorporated for use with metal balls and spring tension arms 0570 (see FIG. 5) or 0970 (see FIG. 9) or trap doors could be used to trap frac balls.

For example, the embodiment shown in FIG. 5 shows the use of spring tension arms 0570 for trapping the ball 0512. In this embodiment, the force of the flowback causes the frac ball 0512 to be pulled into the trap opening 0544 formed by the tension arms 0570. An apparatus 0542 can guide the ball to the trap opening. The force of flowback can be great enough that the frac ball pushes the tension arms outwardly so that the ball goes through the trap opening and into the tool body 0520. Once the ball is within the tool body 0520, the tension arms 0570 can spring back inwardly to trap the ball 0512 within the tool body 0520. The tension arms 0570 can be configured so that the fluid movement forces from flowback can cause the frac ball 0512 to be trapped, but not released when retracting the tool body out of the wellbore. The tension arms 0570 can also be configured to release the ball at a certain pressure during fluid pump down.

In the exemplary embodiment shown in FIG. 5, the device 510 has tapered fingers 0570 on the downhole end that are tapered in a conical manner and curved fins on the uphole end. The conical shape can help the tool body travel downhole by directing imperfections in the wellbore casing around the tool body 0520. Similarly the curved fins can help the tool body travel uphole in the wellbore.

Figure 6:
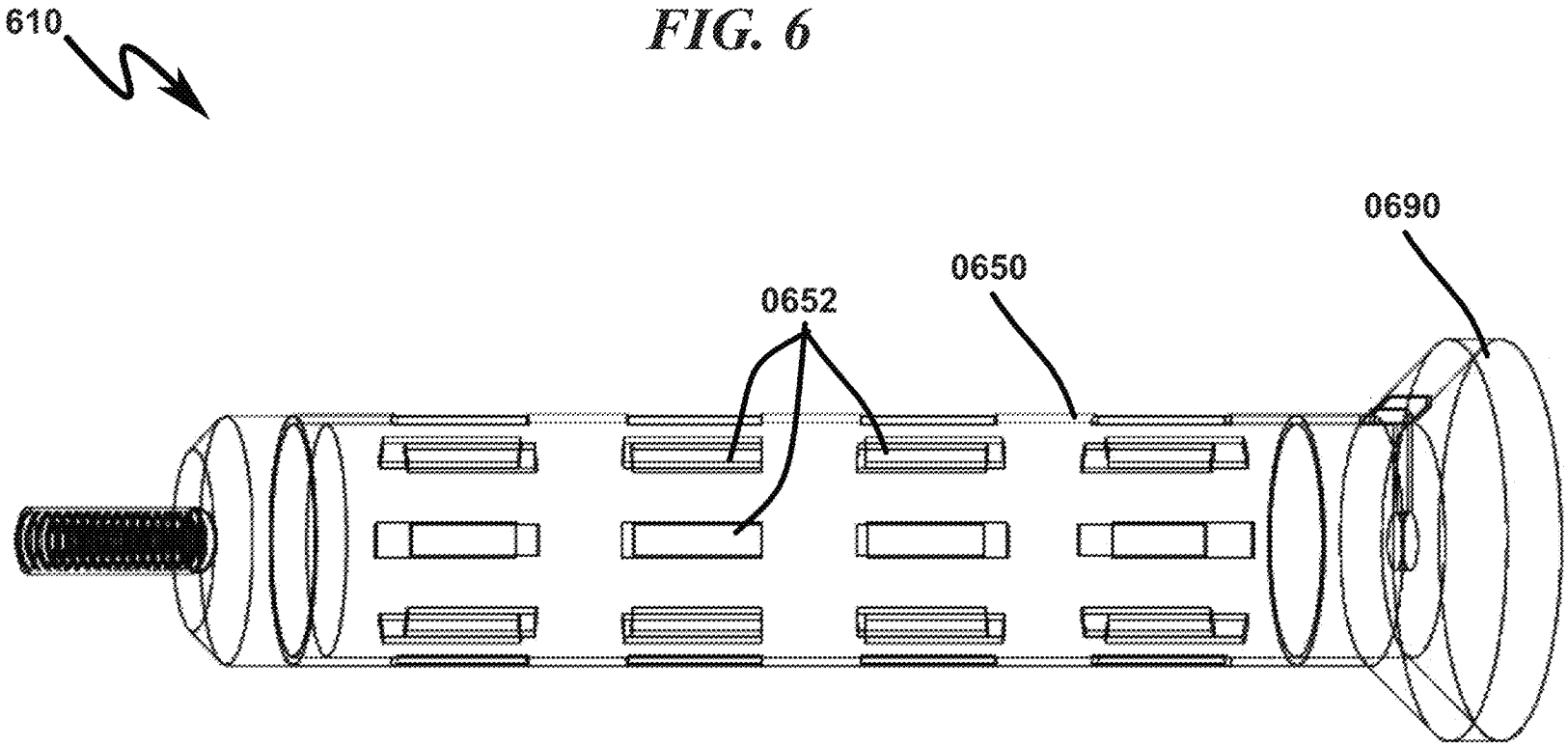
FIG. 6 shows a perspective view of another embodiment of a frac ball retrieval device in accordance with the invention, having a baffle system for catching multiple balls and a spring loaded arm that can depress for a ball to enter and spring back to prevent escape.

The frac ball retrieval device 610 can also have a guide 0690, as shown in the embodiment of FIG. 6, for positioning the frac ball retrieval device within the wellbore. The guides may be desired if the device is configured to be substantially smaller in diameter than the wellbore casing. The guide can be configured for directing the frac ball towards the trap, such as the use of a channeling apparatus.

Figure 4:
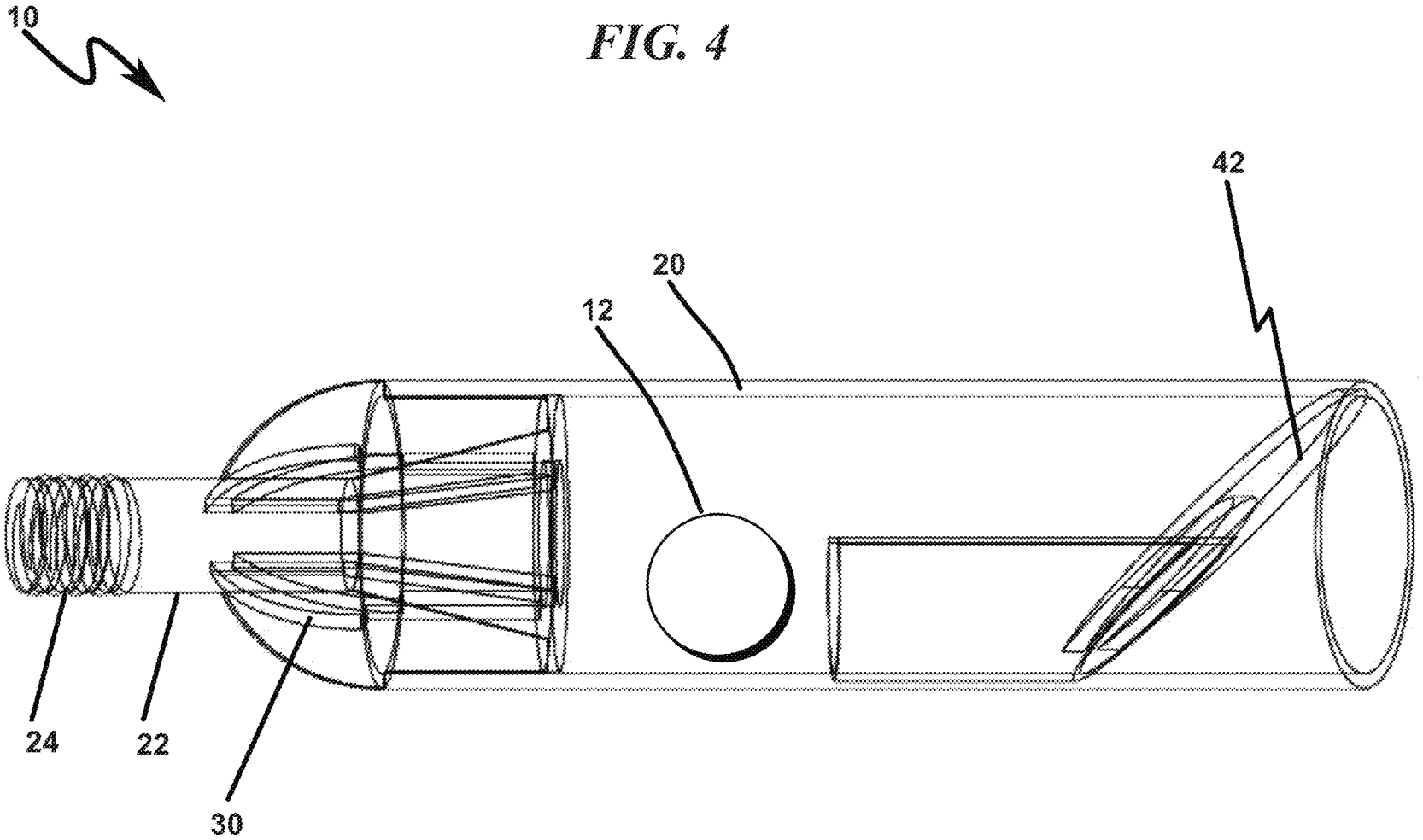
FIG. 4 shows another view of the frac ball retrieval device of FIG. 1

In one exemplary embodiment, as shown in FIGS. 1 and 4, as the frac ball 12 is flowed back towards the surface, it can be channeled into the trap opening 44 and through channel 46 of the chute 48 and into the tool body 20. The fluid movement from wellbore flowback can suck/draw the frac ball into the tool body and towards the hole 52 in the screen 50. When the frac ball lodges into the hole 52, the fluid movement through the hole 52 can be ceased or reduced causing a detectable change in flowback pressure or wireline tension or hanging weight, which can indicate that the frac ball 12 has been caught. Flowback can then be ceased, and the wireline can pull the device 10 out of the wellbore towards the surface. This can cause the fluid movement to reverse direction through the tool body. Fluid can pass through the fins 30 and into the tool body and through the screen. In order to prevent the frac ball from exiting the tool body through the trap opening, trap fluid ports 60 can be placed downhole of the trap opening to direct the frac ball away from the trap opening.

Figure 4A:
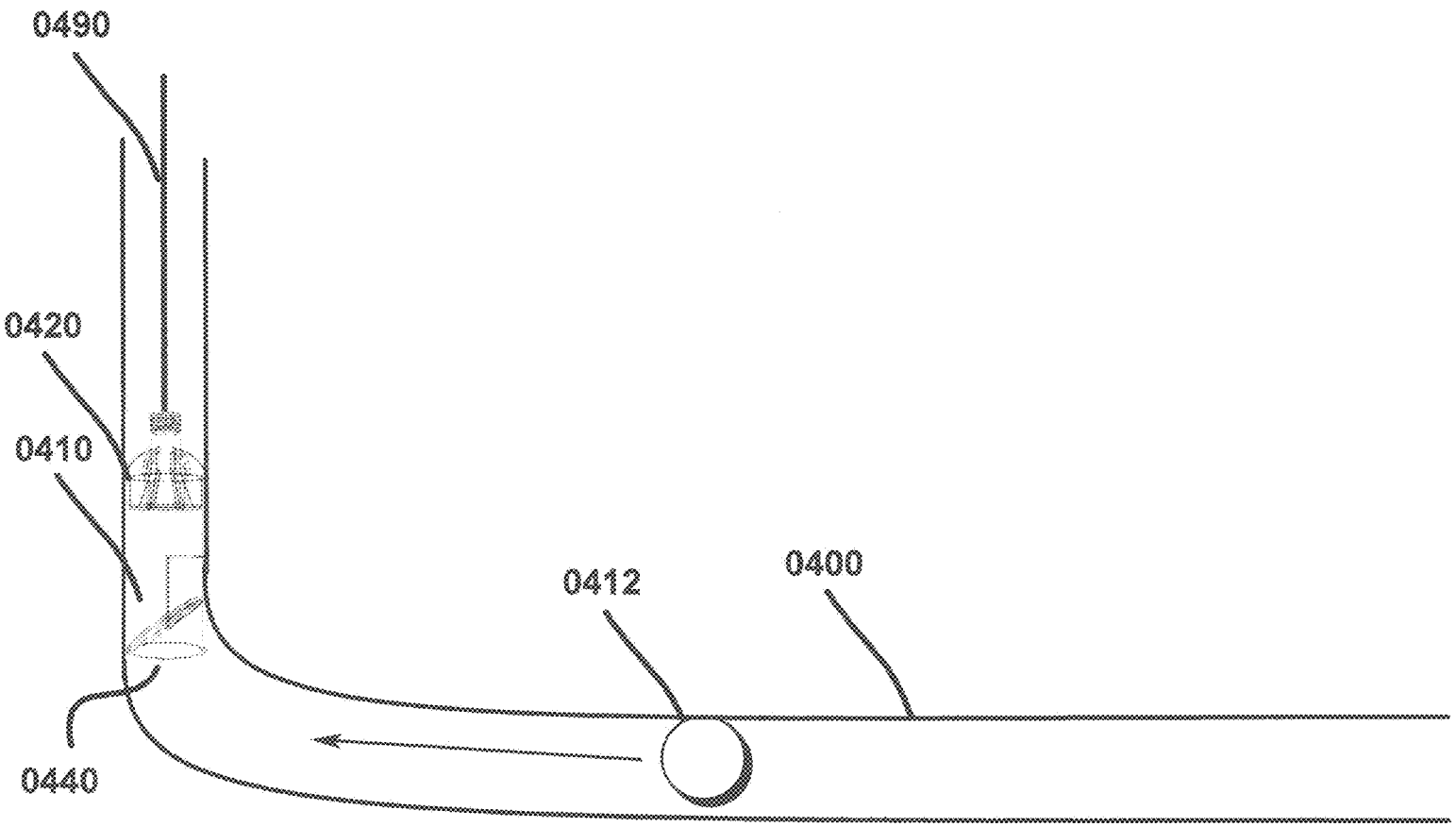
FIG. 4A shows a wellbore retrieval tool positioned at a heel end of a horizontal wellbore casing according to an exemplary embodiment of the present invention.

FIG. 4A generally illustrates a wellbore retrieval tool (0410) deployed into a wellbore casing (0400). The wellbore retrieval tool (0410) may comprise a tool body (0420) that is sized to fit and transported along the inside of the wellbore casing (0400). According to a preferred exemplary embodiment, the tool (0420) may be lowered by a wireline (0490) to a location proximal to a restriction element (0412). The restriction element may be a fracturing ball or any other object that needs to be retrieved. In FIG. 4A, the proximal location is shown as the heel end of the wellbore casing. However, the location may be closer to the restriction element as long as the pumping pressure permits. When a restriction element (0412) needs to be retrieved, the tool (0410) may be deployed to a proximal location to the restriction element and the pressure may be adjusted to flow back the well so that the restriction element is drawn into a trap (0440) in the tool (0420).

Figure 7:
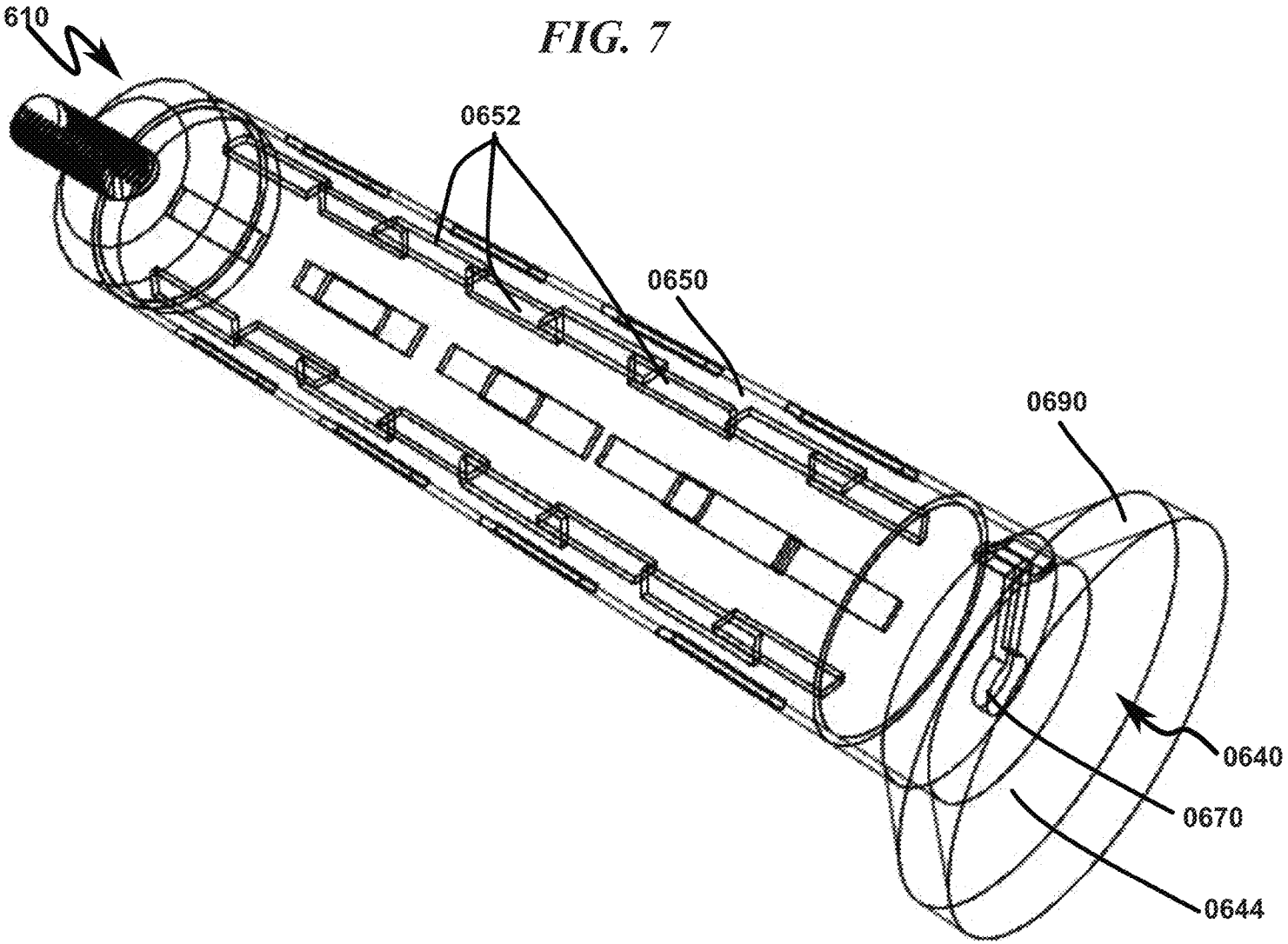
FIG. 7 shows another perspective view of the frac ball retrieval device shown in FIG. 6.
Figure 8:
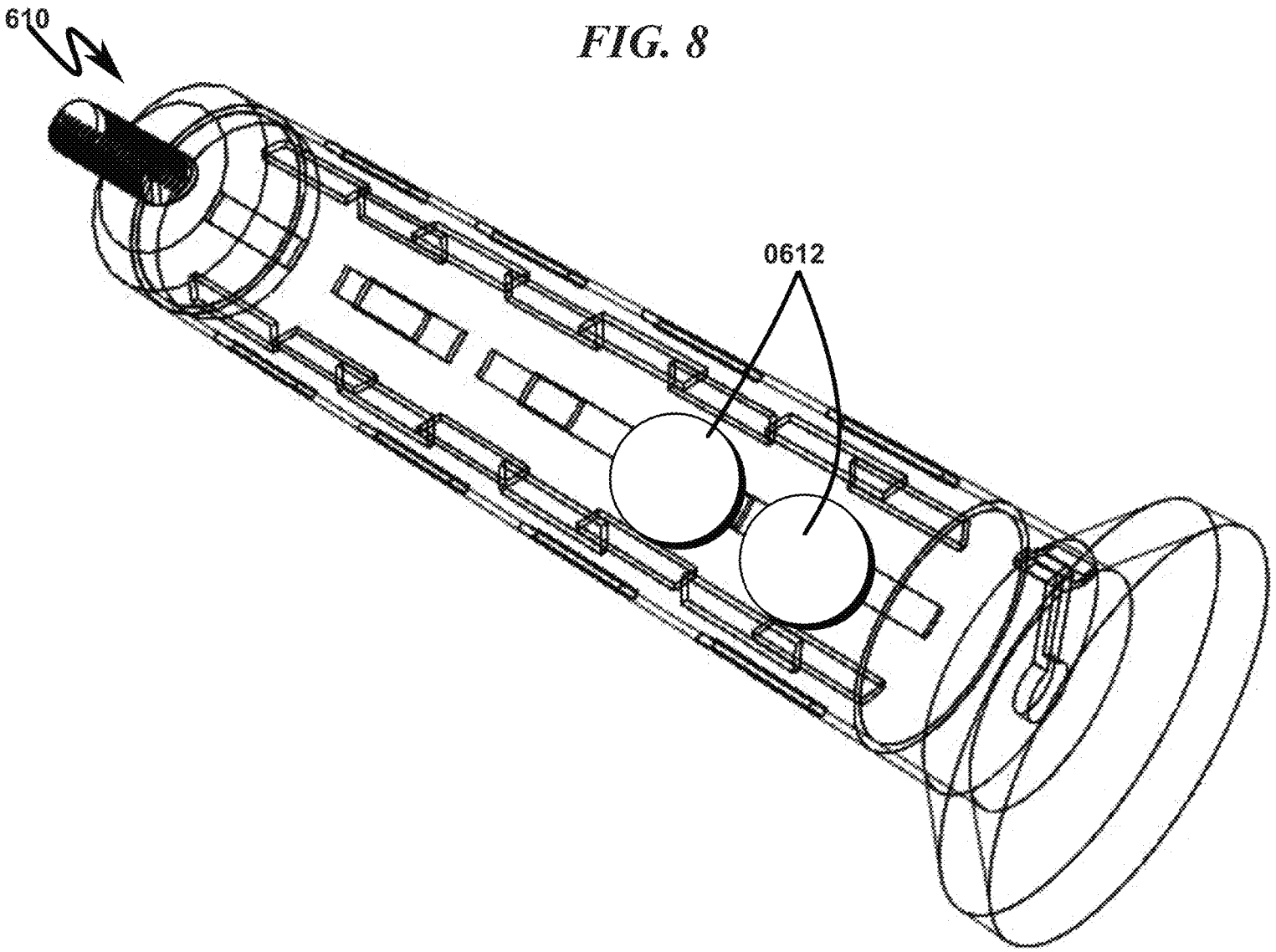
FIG. 8 shows another perspective view of the frac ball retrieval device shown in FIG. 6 with a transparent outer surface and multiple trapped frac balls within the tool body.
Figure 10A:
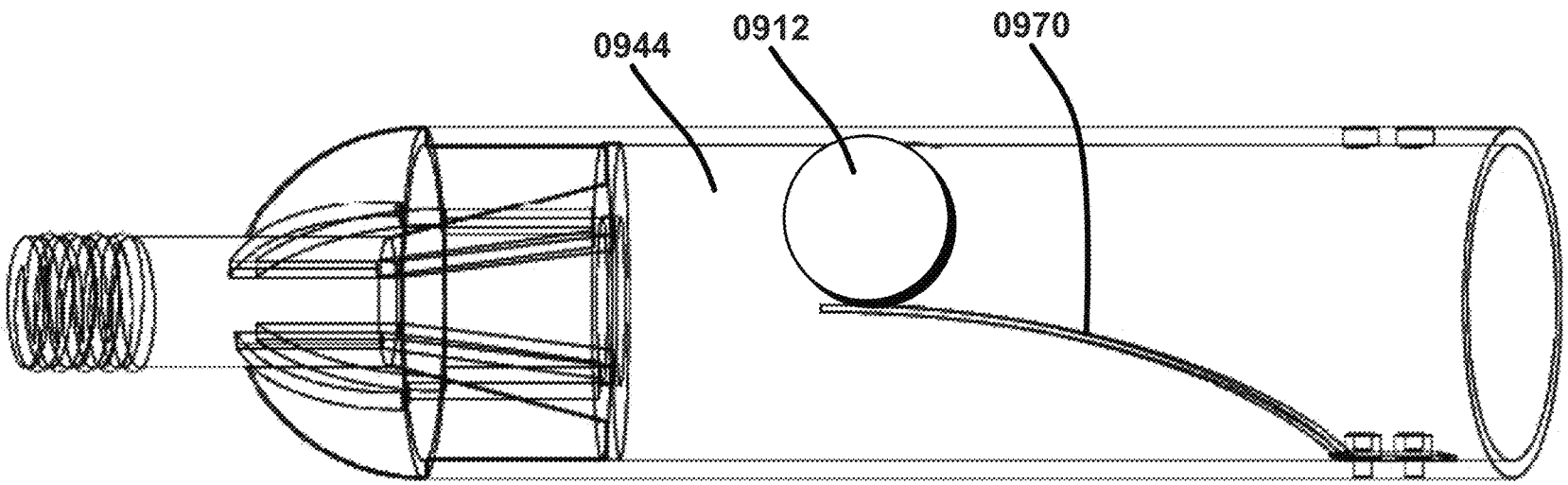
FIG. 10A shows a process for retrieving a frac ball with the frac ball retrieval device of FIG. 9, where the frac ball enters the trap opening according to an exemplary embodiment of the present invention.
Figure 10B:
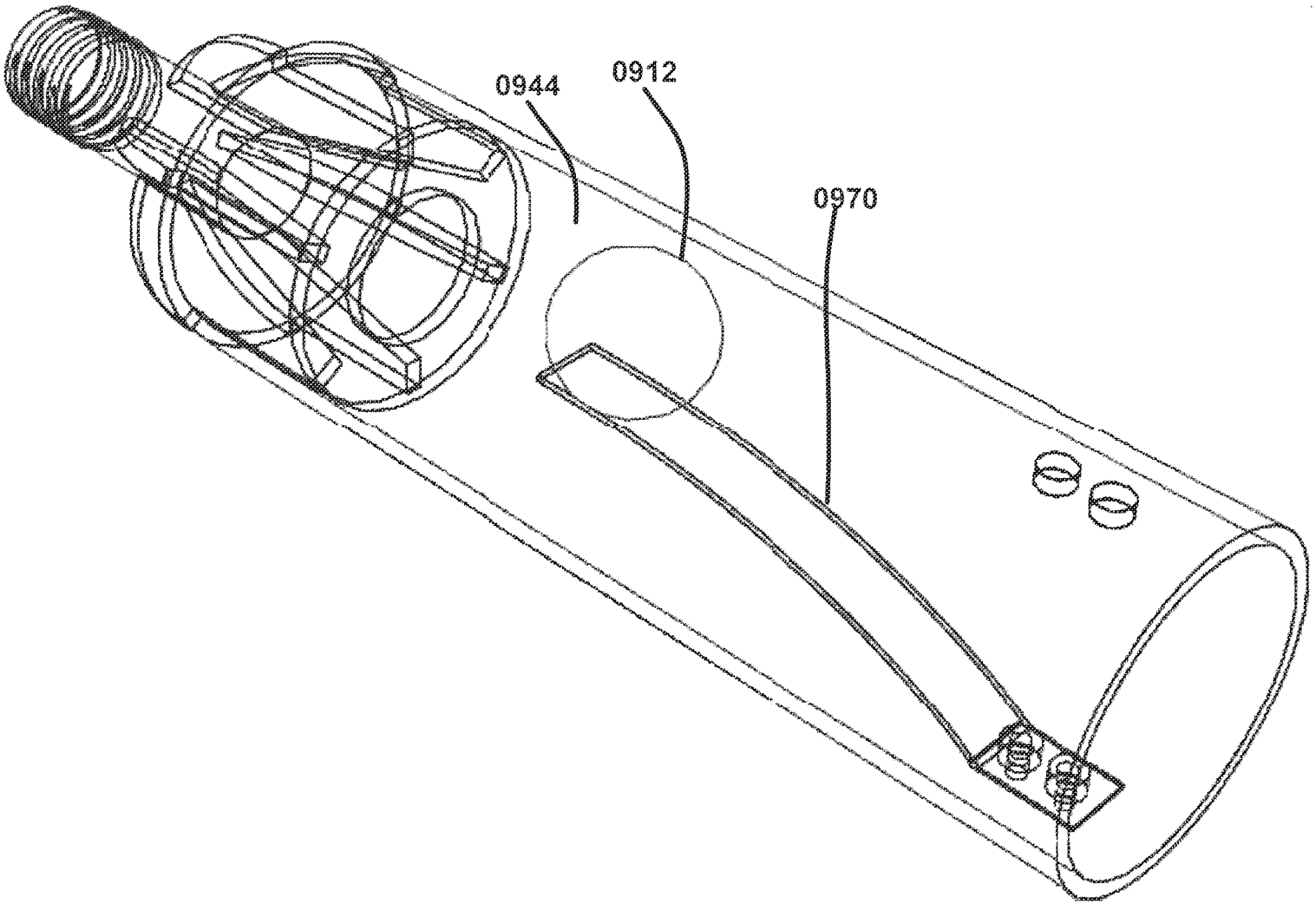
FIG. 10B is a perspective view of a process for retrieving a frac ball with the frac ball retrieval device of FIG. 9, where the frac ball enters the trap opening according to an exemplary embodiment of the present invention.
Figure 11:
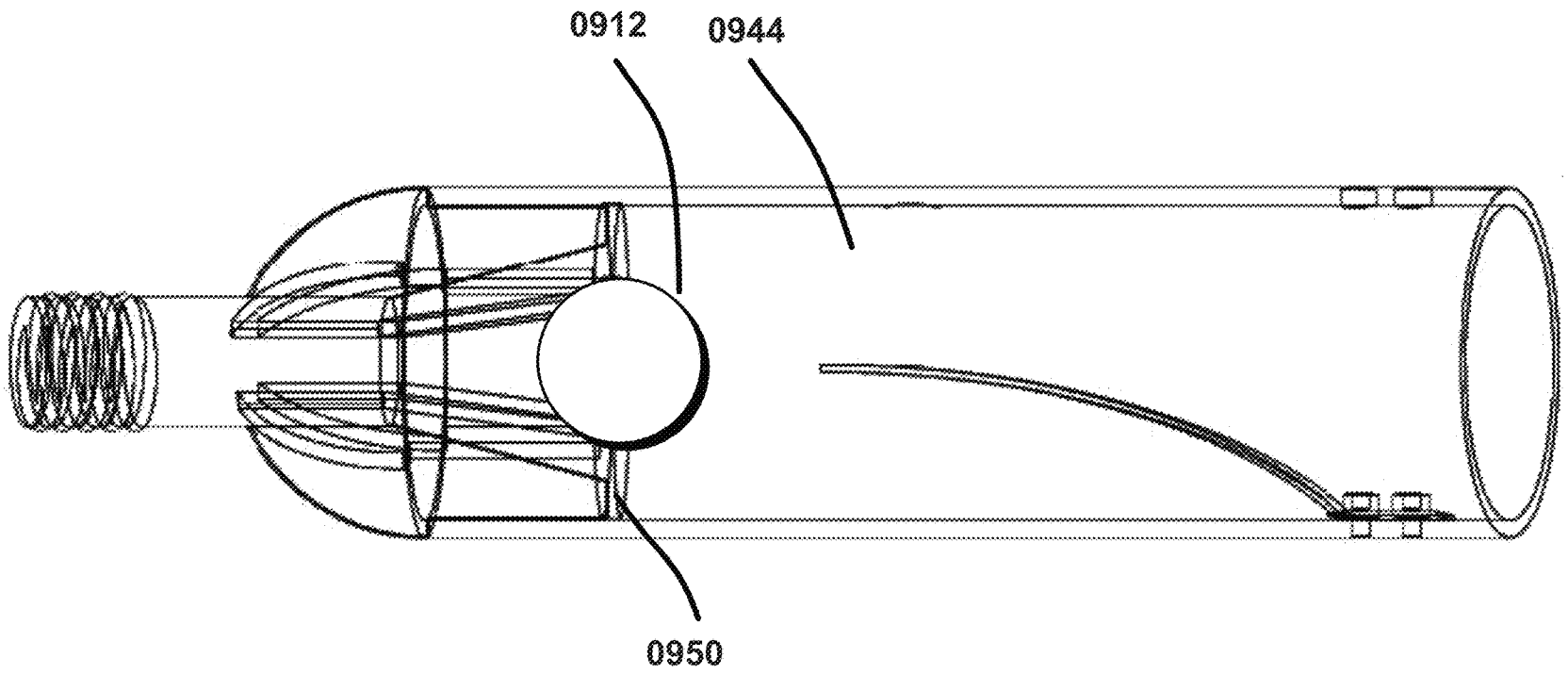
FIG. 11 shows a process for retrieving a frac ball with the frac ball retrieval device of FIG. 9, where the frac ball sets against the screen according to an exemplary embodiment of the present invention.
Figure 12:
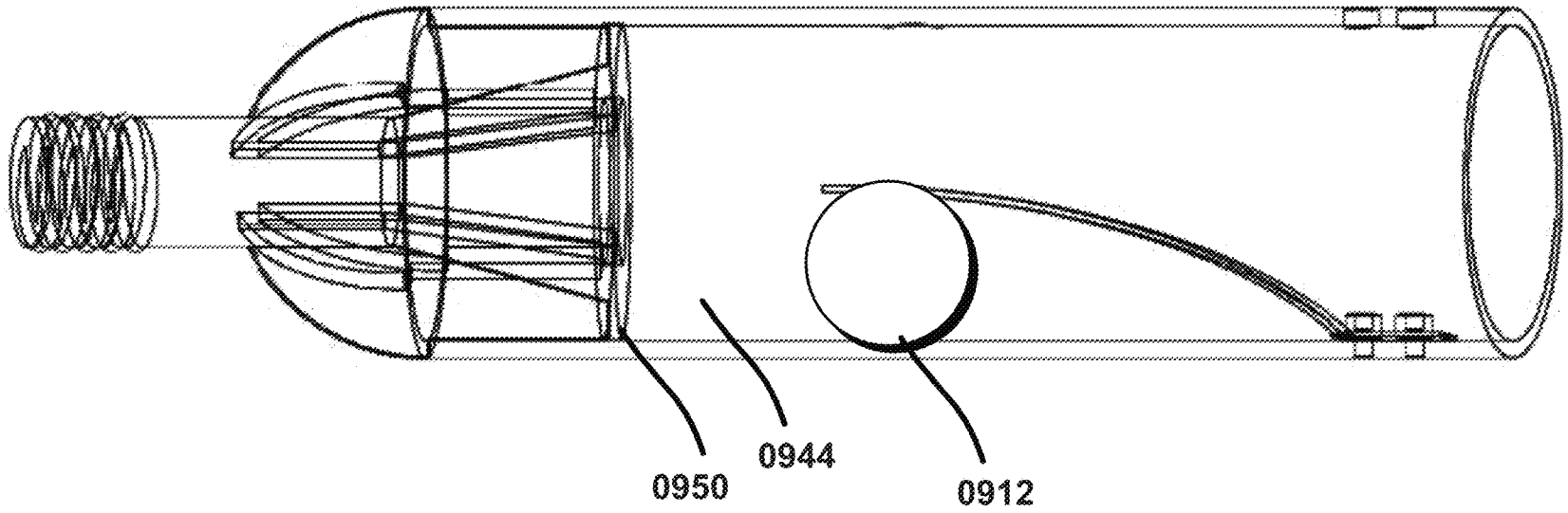
FIG. 12 shows a process for retrieving a frac ball with the frac ball retrieval device of FIG. 9, where the frac ball is trapped according to an exemplary embodiment of the present invention.

Various embodiments of the frac ball retrieval device 10 can be used to retrieve frac balls 0412 or other objects. In FIGS. 1 and 4, an exemplary embodiment of the invention is shown that makes use of a trap 40 that can be advantageous because it has no moving parts. In FIG. 5, an exemplary embodiment of the invention is shown that makes use of a trap with spring tension arms 0570, which can be advantageous for trapping frac balls or other objects that may be irregularly shaped. Additionally, this exemplary embodiment can be configured to release the frac ball or other object using pump down as the spring tension arms can also expand to release the ball by applying sufficient force. In FIG. 6, an exemplary embodiment of the invention is shown that makes use of a baffle screen 0650 for catching multiple balls. The baffle trap can be configured with multiple screen holes 0652 so that one ball entering the trap doesn't completely block fluid flow. This exemplary embodiment shows a trap 0640 (shown in FIG. 7) with a spring-loaded arm 0670 that depresses so balls 0612 shown in FIG. 8 or objects can enter the trap during flowback, but springs back to prevent escape. In FIGS. 9-13, an exemplary embodiment retrieval device 0910 is generally illustrated using a single spring tension arm 0970 housed within a cylindrical tool body 0920, which can depress and allow a frac ball (restriction element) 0912 to enter the trap opening 0944 and then spring back to prevent escape. FIG. 10A illustrates a restriction element 0912 entering a trap opening 0944 retrieval device similar to device 0910. FIG. 10B generally illustrates a perspective view of the retrieval tool with a tension arm. FIG. 11 illustrates a restriction element 0912 entering a trap opening 0944 towards a screen 0950 in the retrieval device 0910. FIG. 12 generally illustrates a restriction element 0912 trapped under a tension arm 0970 so that the restriction element does not escape from the retrieval device 0910.

Figure 13A:
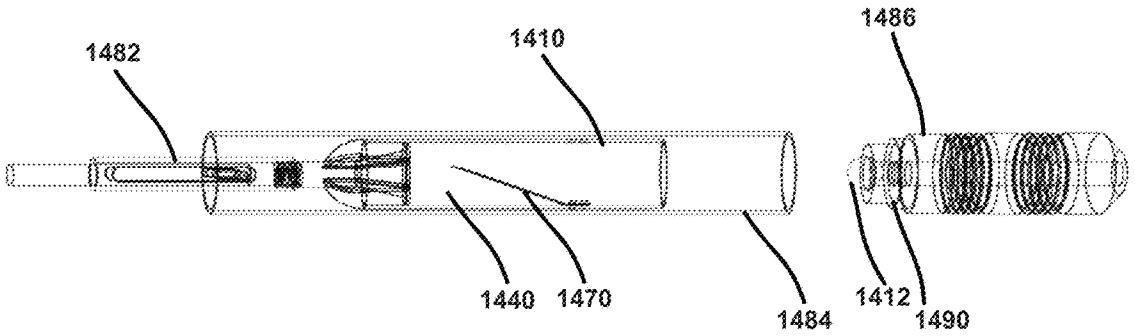
FIG. 13A shows an exemplary embodiment of a wellbore retrieval device in accordance with the invention with a transparent outer surface for viewing the trap, frac ball, screen, and setting tool parts, having the trap built into a plug-setting tool and showing the ball in-place plug in the detached position.
Figure 13B:
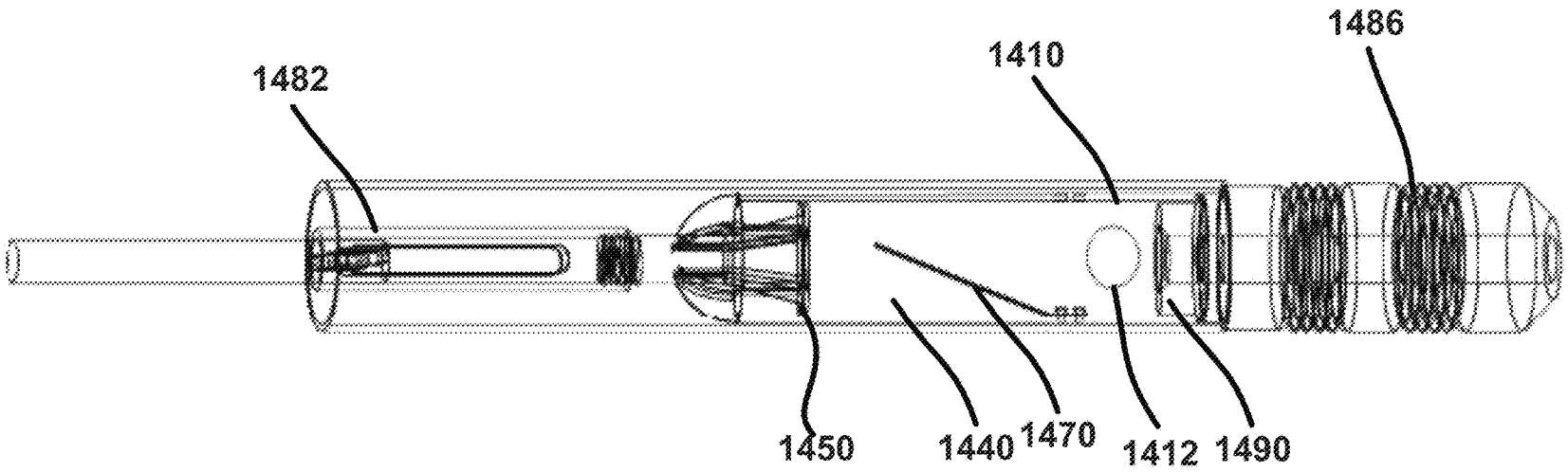
FIG. 13B shows an exemplary embodiment of a wellbore retrieval device in accordance with the invention with a transparent outer surface for viewing the trap, frac ball, screen, and setting tool parts, having the trap built into a plug-setting tool and showing the ball in-place plug in the attached position
Figure 14:
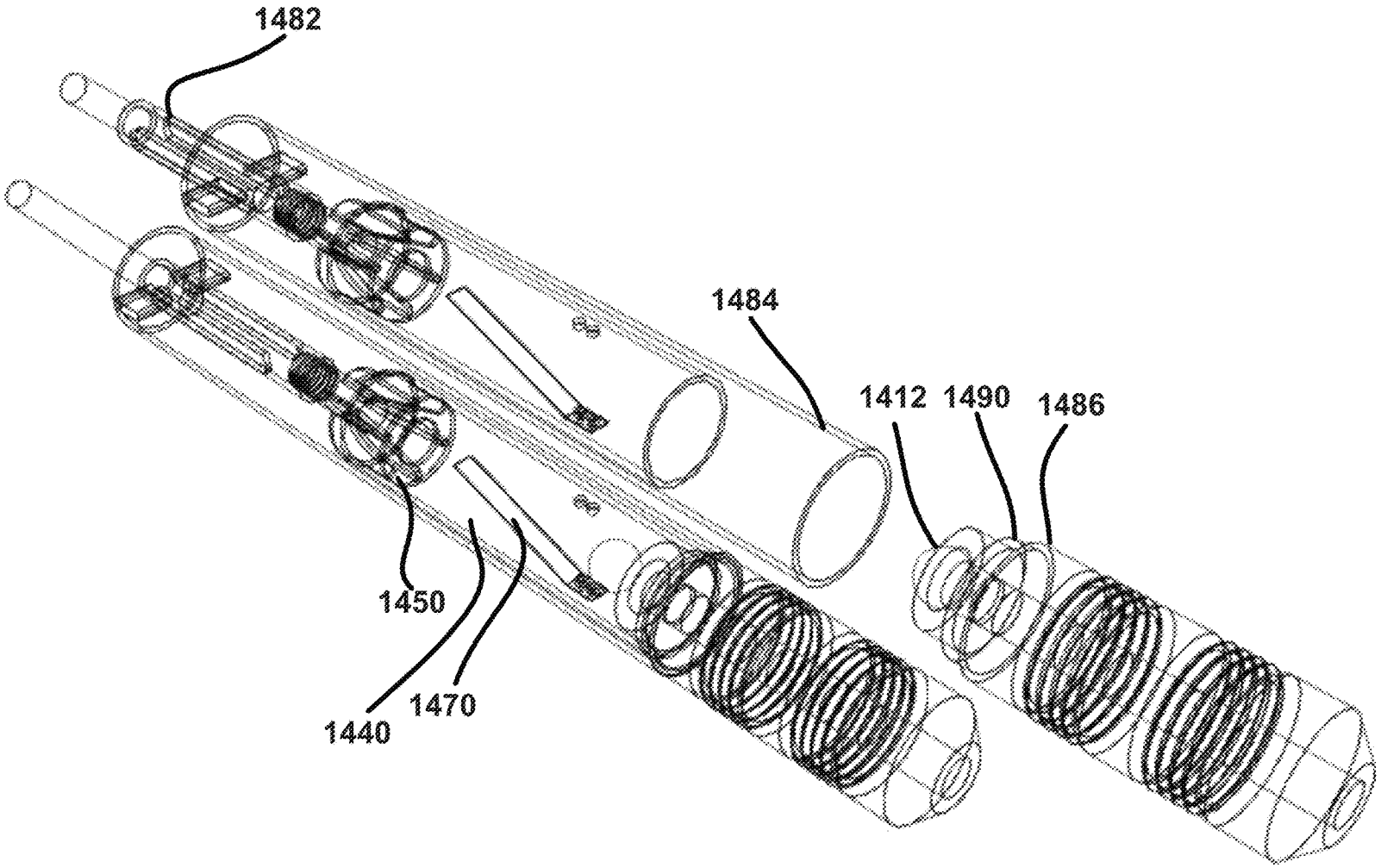
FIG. 14 shows perspective views of an exemplary embodiment of a wellbore retrieval device in accordance with the invention with a transparent outer surface for viewing the trap, frac ball, screen, and setting tool parts, having the trap built into a plug-setting tool and showing the ball in-place plug in the attached and detached positions.

In FIGS. 13-14, an exemplary embodiment of the invention is shown that also incorporates ball retrieval tool 1410 with a plug-setting (wellbore setting) tool 1482 on a tool string. FIG. 13A generally illustrates a wellbore setting tool 1482 and a setting sleeve 1484. A wellbore retrieval tool 1410 may be transported within the sleeve 1484 of the wellbore setting tool. According to a preferred exemplary embodiment, a trap 1440 with a spring tension arm 1470 may be housed within the plug-setting sleeve 1484 that can be run with the tool string for setting a ball-in-place (restriction element) 1412 plug 1486. According to yet another preferred exemplary embodiment, the wellbore retrieval tool is armed to trap a restriction element upon separation of the wellbore setting tool from the wellbore retrieval tool. For example, when the wellbore setting tool 1482 pulls away from the shear ring 1490 of the wellbore retrieval tool 1410, the tension arm 1470 may be armed to trap subsequent restriction elements. The plug 1486 may be a fracturing plug. According to a preferred exemplary embodiment the plug is configured to enable fluid communication. According to a preferred exemplary embodiment, the plug 1486 is configured with a shear ring 1490 that may be used to separate the wellbore retrieval tool 1410 from wellbore setting tool 1482 after setting the plug with the restriction element 1412. According to another preferred exemplary embodiment, the plug 1486 may be set by transmitting a setting force from wellbore setting tool 1482 through the wellbore retrieval tool 1410. This exemplary embodiment can be advantageous because ball retrieval can occur immediately after the ball-in-place plug is set. According to yet another preferred exemplary embodiment, the restriction element 1412 may be deployed against the plug 1486 when the wellbore setting tool 1482 sets the plug 1486. According to a further preferred exemplary embodiment, the setting of the plug and the deployment of the restriction element take place simultaneously. According to a further preferred exemplary embodiment, the deployment of the restriction element take place after the setting of the plug. For example a pump down mechanism may be used to deploy the restriction element 1412 after the plug 1486 is set. FIG. 13B generally illustrates a wellbore setting tool 1482 setting a plug 1486 along with a wellbore retrieval tool carrying a restriction element 1412. FIG. 14 generally illustrates a perspective view of the wellbore retrieval tool and a ball-in-place plug.

The invention also provides for a method for retrieving a frac ball situated in a wellbore, by transporting a frac ball trap down a wellbore, flowing back the wellbore so that the situated frac ball flows backwards towards the frac ball trap, and trapping the frac ball in the frac ball trap. The method can also provide for retracting the frac ball trap and frac ball out of the wellbore casing. The frac ball trap may be a frac ball retrieval device 10. This method can allow for the retrieval of frac balls 0412 or other objects such as debris in the wellbore casing. This can provide the benefit of saving a substantial amount of time and fluid usage in flowback operations due to not having to flow the frac ball all the way back to or near the surface of the wellbore.

This method can be used to retrieve a ball 0412 from a perforation plug. This method can also be used to retrieve a frac ball from a ball-actuated sliding sleeve. This can be desired if there have been formation difficulties and it is desired to retrieve a ball from an actuated sleeve to allow fluid to pass to downhole stages. This can relieve a lockout condition and allow the pumping down of a different ball down to actuate a subsequent sleeve so that the badly formed stage is skipped. This can prevent the need to drill out the sleeve causing the lockout and all subsequent sleeves to alleviate the lockout condition. Instead, the ball-retrieval device 10 can be used to remove the frac ball from the sleeve causing the lockout, allowing the operators to skip that stage, and start actuating subsequent sleeves.

This method can be adapted to retrieve other objects from a wellbore besides frac balls.

The invention also provides for a system for completing fracturing stages in a wellbore having at least one plug and perf run for plugging and isolating a previously fractured stage and perforating a subsequent stage and at least one ball retrieval for retrieving a frac ball 0412 from a set ball-in-place plug during a lockout condition. The ball-retrieval tool 10 can be part of a tool string with a perforating gun, and the perforating guns can be fired after ball retrieval. The ball retrieval tool can be part of a tool string in the plug and perf run, and ball retrieval can occur during the plug and perf run.

In the plug and perf run, a tool string having a perforating gun, a plug setter tool, and a ball-in-place plug can be run down the wellbore. The ball-in-place plug can be set to isolate the previously fractured stage during the same run. The perforating gun can be fired to perforate the subsequent stage. The remaining tool string can then be retracted out of the wellbore.

Additional plug and perf runs can be made to continue further completion of the wellbore until ball retrieval is needed or desired. A ball-retrieval can be necessary if a lockout condition occurs. For example, the perforating guns could fail to fire properly and fail to create perforations. With the frac ball 0412 already seated to plug the prior stage, a lockout condition can occur. At which point, it may be desired to make a ball-retrieval to retrieve the frac ball.

A ball-retrieval can be made for retrieving a frac ball from a set ball-in-place plug during a lockout condition. A ball-retrieval tool 10 can be run down the wellbore as far as the lockout condition will allow. This ball-retrieval tool can also be made part of the tool string of the plug and perf run such that ball retrieval can occur during the plug and perf run. Flowback of the wellbore can then be conducted so that the frac ball flows backwards towards the ball-retrieval tool. The frac ball can then be trapped in the ball-retrieval tool to alleviate the lockout condition. The ball-retrieval tool can then be retracted out of the wellbore.

In another preferred exemplary embodiment, a ball-retrieval can be combined with a perforation run, a ball retrieval and perf run, or a plug and perf run. The ball-retrieval tool 10 can be part of a tool string with a perforating gun in the ball-retrieval run. After retrieval, the perforating gun can then be placed at a desired location and fired to perforate the desired location during the ball retrieval run. The tool string can then retracted out of the wellbore.

The invention can also be configured to retrieve other objects from the wellbore. As such, the invention provides for a wellbore retrieval device, indicated generally at 10, having a tool body 20 configured to be transported through a wellbore, a trap 40 configured to retrieve at least one object situated within the wellbore, and a means for transporting the tool body through the wellbore for retrieving the object at a location within the wellbore.

The frac ball retrieval device 10 can provide for the ability to more efficiently retrieve frac balls 412. This device can be used in connection with the inventive method for retrieving a frac ball situated in a wellbore and the inventive system for completing fracturing stages in a wellbore. The ability to more efficiently remove frac balls can make efficiency improvements in the overall completion process, thereby saving time and money. The device can also remove frac balls or other objects from a wellbore in other circumstances.

In this method and system for the completion of fracturing stages, tool strings can be run with perforating guns and a plug setter tool using ball-in-place plugs to save time and fluid usage. These tool strings can also incorporate a frac ball retrieval device for immediate use if a situation arises where ball retrieval is desired. The ball-in-place plug can be set to isolate the lower section during the same run, thereby saving the step of retracting the perforating guns to inspect for proper firing and then pumping down a frac ball separately. With the invention, it can be more economical and practical to run ball-in-place plugs knowing that the seated frac ball 0412 may be more efficiently removed if the perforating guns fail to fire properly and cause a lockout condition.

With the inventive system, the perforating guns can be fired on the subsequent section during the same run after setting the ball-in-place plug. Then the tool string can then be backed out and inspected for proper firing. In the event of a lockout, whether due to misfires, formation difficulties, or screen out condition, a ball-retrieval tool string can be run having the perforating guns with a ball retrieval device 10 substituted for the plug setter tool. The ball retrieval tool string can be lowered through the wellbore as much as possible using gravity and momentum, generally near the heel of the wellbore. Thereafter, the ball-retrieval tool string can be pushed into the horizontal wellbore with injected fluid as far as the lockout condition will allow.

In embodiments incorporating a frac ball retrieval device in the tool string with perforating guns, plug-setting tool, and ball-in-place plugs, a plug and perf run can be conducted and ball retrieval can be readily available if needed. The tool string can be run to the desired stage, the ball-in-place plug can be set, and the perforating guns can be fired on the subsequent stage. If a situation arises where it is desired to remove the frac ball from the ball-in-place plug, flowback can be immediately commenced to flow the frac ball into the trap that is already situated near the ball-in-place plug.

The hanging weight of the ball-retrieval tool string can be monitored at the surface. Flowback operations of the wellbore can be commenced such that the seated frac ball 0412 of the set plug is released and flows back towards the ball retrieval device 10. The frac ball 0412 can be trapped into the ball-retrieval device and can seat against the screen 50, which can redirect fluid movement and change the hanging weight of the tool string in such a manner that it can indicate that the frac ball has been caught.

Flowback operations can then be stopped. Since the lower section is no longer isolated, the lockout condition can be alleviated, and a tool string can be pumped down the well to the desired location for firing perforating guns. The tool string can then be pulled out, a replacement frac ball can be pumped down to seat into the plug, and regular completion and formation operations using ball-in-place plugs can proceed. A tool string using the ball-retrieval device 10 can also be run without the perforating guns if desired.

The inventive device and method can allow for ball retrieval to occur far into the wellbore. This saves a substantial amount of time and fluid usage in flowback operations than flowing the frac ball 0412 all the way back closer to the surface. This method can lessen the amount of fluid and proppant displacement downhole. This method can lessen the amount of production water needing disposal. This method can lessen the amount of gases and chemicals being brought to the surface. The frac ball-retrieval device 10 can also be configured to operate in a variety of casing sizes.

The ball-retrieval device 10 can be configured to work with wireline equipment already being used for tool strings, which can save the cost of and the delay of waiting for special equipment or a special servicing crew to come deal with a lockout condition.

The ball-retrieval device 10 and method can make running ball-in-place plugs more practical and economical since thousands of barrels of water can be saved by not having to pump the ball down separately. Much time can be saved by not waiting for the ball to free fall through the vertical portion of the wellbore. The number of times wellhead valves must be cycled can be substantially reduced since they don't have to be opened and closed to allow a separately dropped frac ball to enter the well. There can also be a reduction in the number of high pressure equalization and bleed off operations.

Preferred Exemplary Wellbore Object Retrieval Flow Chart Method

Figure 15:
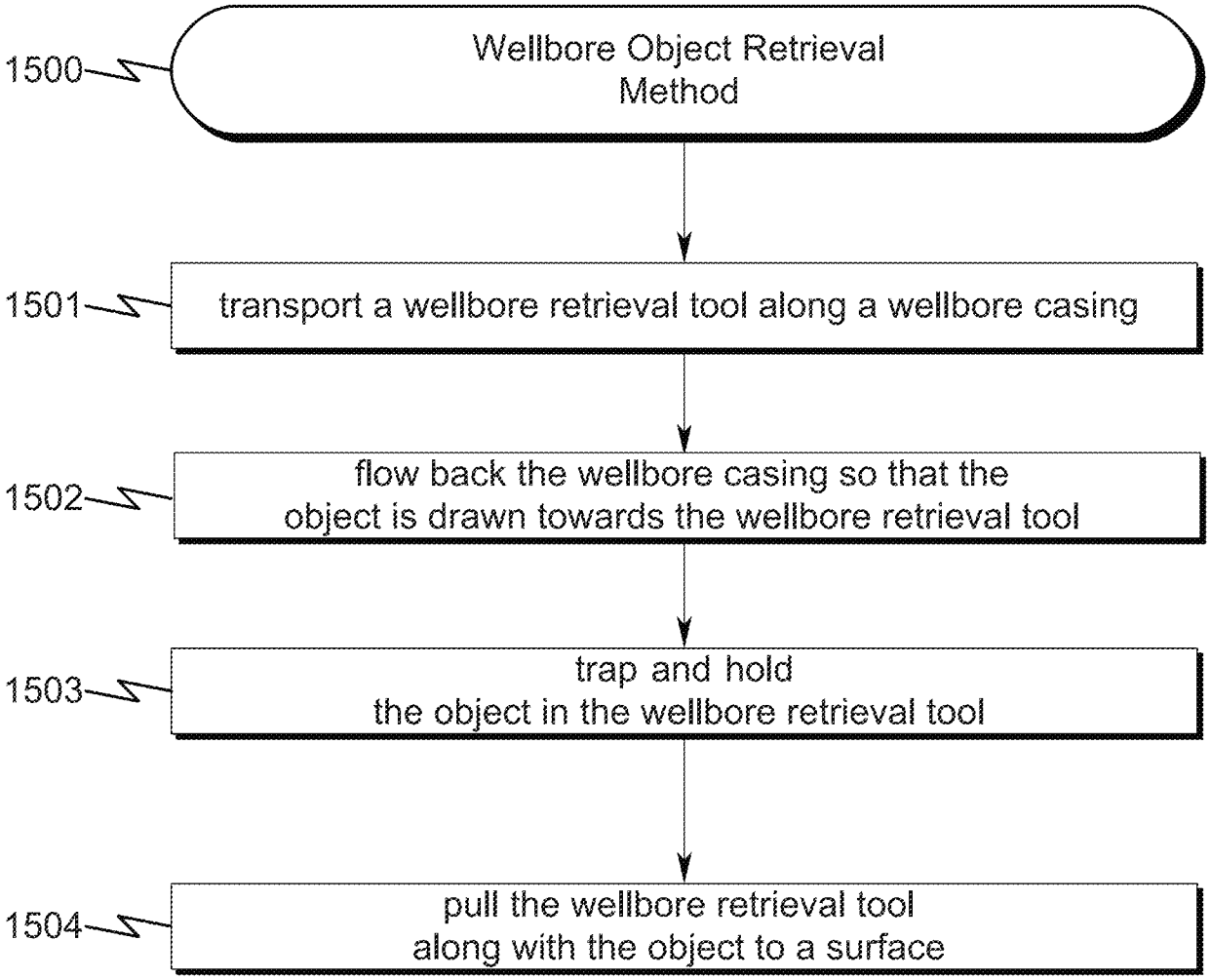
FIG. 15 illustrates a flow chart method for retrieving an object from a wellbore casing according to an exemplary embodiment of the present invention.

As generally illustrated in FIG. 15 (1500), a preferred exemplary wellbore object retrieval flow chart method for retrieving an object in a wellbore casing with a wellbore retrieval tool may be generally described in terms of the following steps:

(1) transporting the wellbore retrieval tool along the wellbore casing (1501); The ball retrieval tool string may be lowered through the wellbore casing as much as possible using gravity and momentum, generally near the heel of the wellbore. Thereafter, the ball retrieval tool can be pushed into the horizontal wellbore with injected fluid as far as the lockout condition will allow.

(2) flowing back the wellbore casing so that the object flows backwards towards the wellbore retrieval tool (1502);

(3) trapping and holding the object in the wellbore retrieval tool (1503); and (4) pulling the wellbore retrieval tool along with the object to a surface (1504).

Preferred Exemplary Wellbore Plugging System

Figure 16:
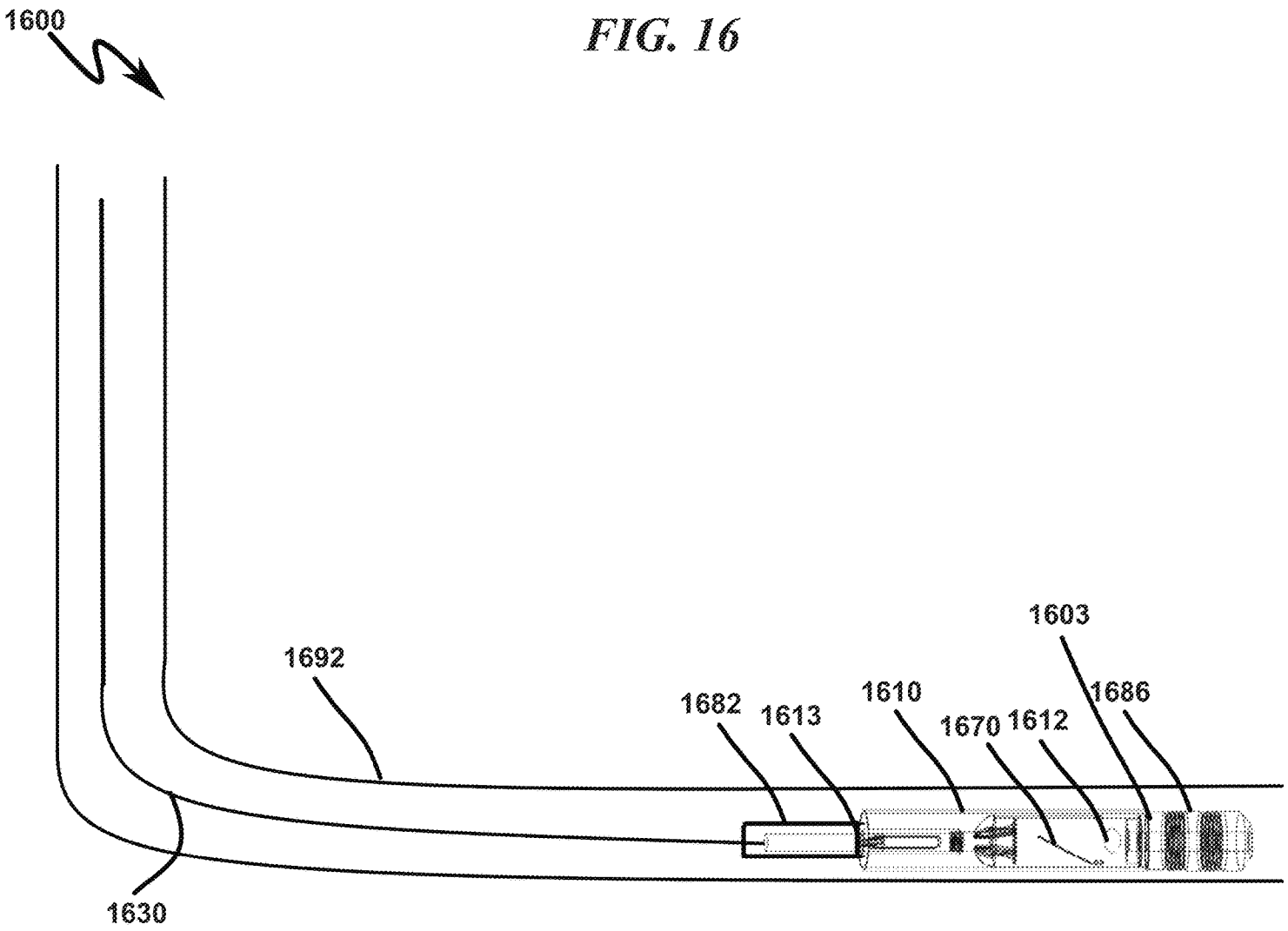
FIG. 16 illustrates an exemplary wellbore plugging system comprising a wellbore retrieval tool, a ball-in-place plug with a restriction element and a wellbore setting tool for use in a wellbore casing according to an exemplary embodiment of the present invention.

FIG. 16 generally illustrates a preferred exemplary wellbore plugging system deployed into a wellbore casing (1692) with a wireline (1630), coiled tubing or rigid tubing. The plugging system may comprise a wellbore setting tool 1682, a wellbore retrieval tool 1610 and a ball-in-place plug 1686 with a restriction element 1612. The wellbore retrieval tool 1610 may be transported within a sleeve of the wellbore setting tool. The ball-in-place plug 1686 may be mechanically coupled to the wellbore retrieval tool so that when the plug is set by the wellbore setting tool, the retrieval tool 1610 remains with the plug 1686 after the setting tool is separated. The setting tool may be mechanically coupled to the wellbore retrieval tool 1610 via a coupling mechanism such as a shear ring. The retrieval tool 1610 may be positioned in between the plug and the setting tool 1682 so that the retrieval tool 1610 is upstream (towards heel end) of the ball-in-place plug 1686 and downstream (towards toe end) of the wellbore setting tool 1682. It should be noted that any mechanical coupling mechanisms may be used to couple the plug, retrieval tool and the setting tool. The wellbore retrieval tool 1610 may be operatively coupled to the wellbore setting tool 1682 on an upstream end (1613) of the wellbore retrieval tool and the wellbore retrieval tool 1610 operatively coupled to the ball-in-place plug 1686 on a downstream end (1603) of the wellbore retrieval tool 1610. According to a preferred exemplary embodiment, the plug 1686 is configured with a shear ring that may be used to separate the wellbore retrieval tool 1610 from wellbore setting tool 1682 after setting the plug with the restriction element 1612. According to another preferred exemplary embodiment, the plug 1686 may be set by transmitting a setting force from wellbore setting tool 1682 through the wellbore retrieval tool 1610.

Preferred Exemplary Wellbore Plugging Method Flowchart

Figure 17:
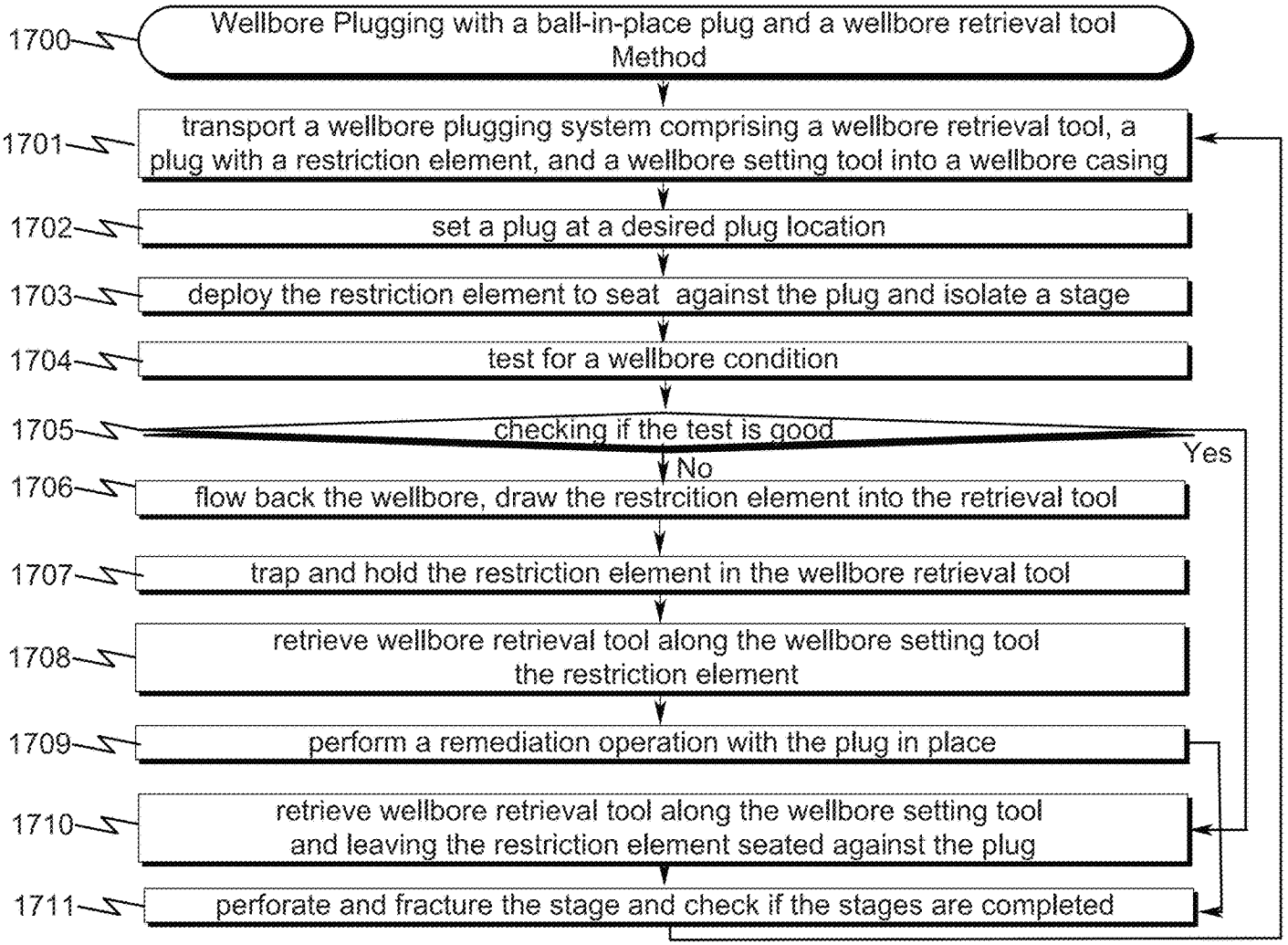
FIG. 17 illustrates a wellbore plugging flow chart method for use in a wellbore casing according to an exemplary embodiment of the present invention.

As generally illustrated in FIG. 17 (1700), a preferred exemplary wellbore plugging flow chart method in a wellbore casing with a wellbore plugging system as illustrated in FIG. 16 (1600) may be generally described in terms of the following steps:

(1) transporting a wellbore retrieval system comprising a wellbore retrieval tool, a plug with a restriction element, and a wellbore setting tool into the wellbore casing (1701);

tool strings may be run with perforating guns and a plug setter tool (wellbore setting tool) using ball-in-place plugs to save time and fluid usage. These tool strings may also incorporate a retrieval tool for immediate use if a situation arises where ball retrieval is desired. The restriction element may be any plugging element such a fracturing plug. The fracturing plug may be shaped circular, cylindrical or a dart.

(2) setting a plug at a desired plug location (1702);
the plug may be set a desired location to isolate a stage that needs to be fractured.

(3) deploying the restriction element to seat against the plug and isolating a stage (1703);
the restriction element such as a fracturing ball may seat on the set plug. The setting of the plug as in step (2) and the deployment of the restriction element as in step (3) may be performed simultaneously. Alternatively, the setting of the plug as in step (2) may be performed prior to the deployment of the restriction element as in step (3). The restriction element may be deployed by pumping fluid so that the restriction element seats against the plug. The plug may be configured for fluid communication downstream of the wellbore casing.

(4) testing for a wellbore condition (1704);
One test may be to check for proper injection. The well may be in a hydraulic lockout condition when there is improper injection to the hydrocarbon formation. Another condition may be to retrieve the restriction element for inadequate plugging. Pumping fluid from the surface to check if the injection of the stage that was perforated is good.

(5) checking if testing is good, proceeding to step (11) (1705);
the check may be performed by the pumped fluid in step (4).

(6) flowing back the wellbore so that the restriction element is drawn towards the wellbore retrieval tool (1706);
if the injection in step (5) is bad due to a hydraulic lockout or other conditions, the wellbore may be flowed back so that the restriction element is trapped and held in the wellbore retrieval tool as shown in step (7).

(7) trapping and holding the fracturing ball in the wellbore retrieval tool (1707);

(8) retrieving the wellbore retrieval tool along with the restriction element, and the wellbore setting tool (1708);

(9) performing a remediation operation with the plug in place (1709) and proceeding to step (11);
a remediation operation such as pumping another restriction element may be performed. Alternatively, a perforating gun string may be pumped and the stage perforated after dropping a restriction element. Any other remediation step necessary to establish injection and alleviate a hydraulic lockout condition may be performed.

(10) retrieving the wellbore retrieval tool along with the wellbore setting tool (1710); and

(11) performing perforating and fracturing operations and proceeding to step (1) (1711).
A check may be performed to check if more stages need to be perforated and fractured before proceeding to step (1). If more there are no more stages to be perforated and fractured, then wellbore may be prepared for production.

Preferred Exemplary Wellbore Completion System

Figure 18:
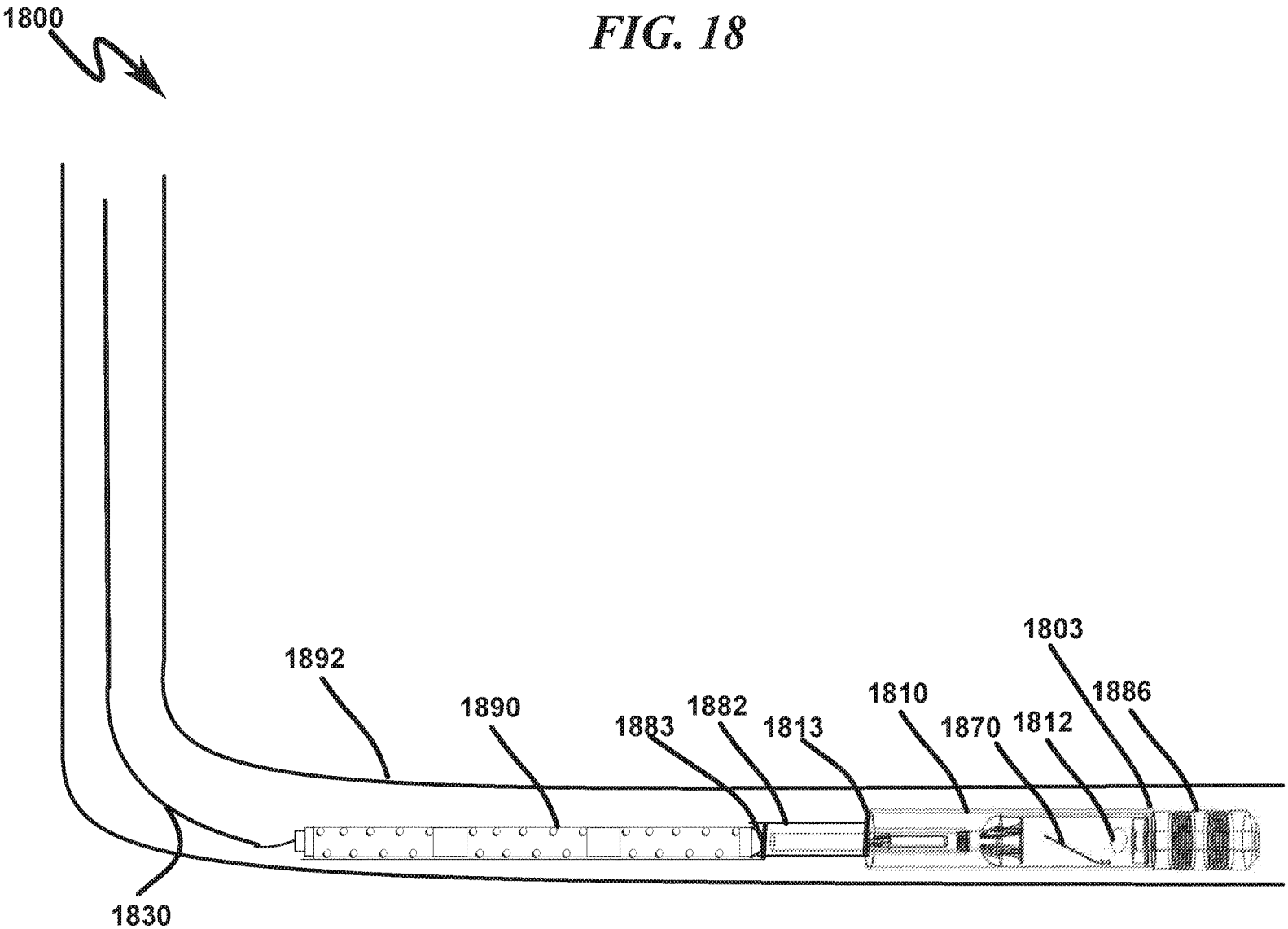
FIG. 18 illustrates an exemplary wellbore completion system comprising a wellbore retrieval tool, a ball-in-place plug with a restriction element, a perforating gun and a wellbore setting tool for use in a wellbore casing according to an exemplary embodiment of the present invention.

FIG. 18 generally illustrates a preferred exemplary wellbore plugging system deployed into a wellbore casing (1892) with a wireline (1830), coiled tubing or rigid tubing. The completion system may comprise a wellbore setting tool 1882, a wellbore retrieval tool 1810, a ball-in-place plug 1886 with a restriction element 1812 and a gun string assembly 1890. The wellbore retrieval tool 1810 may be housed within a sleeve of the wellbore setting tool. The ball-in-place plug 1886 may be mechanically coupled to the wellbore retrieval tool so that when the plug is set by the wellbore setting tool, the retrieval tool 1810 remains with the ball-in-place plug 1886 after the setting tool is separated. The setting tool 1882 may be operatively coupled to the wellbore retrieval tool 1810 via a coupling mechanism such as a shear ring. The retrieval tool 1810 may be positioned in between the plug and the setting tool 1882 so that the retrieval tool 1810 is upstream (towards heel end) of the ball-in-place plug 1886 and downstream (towards toe end) of the wellbore setting tool 1882. It should be noted that any mechanical coupling mechanisms ordinarily used by the completion tools may be utilized to couple the plug, retrieval tool and the setting tool. The wellbore retrieval tool 1810 may be operatively coupled to the wellbore setting tool 1882 on an upstream end (1813) of the wellbore retrieval tool and the wellbore retrieval tool 1882 operatively coupled to the ball-in-place plug 1886 on a downstream end (1803) of the wellbore retrieval tool 1810. The perforating gun is operatively coupled at an upstream end (1883) of said wellbore setting tool. The gun string assembly (1890) may comprise plural perforating guns connected by subs or tandems. The perforating guns may be a select fire switch system or conventional perforating guns. As illustrated in FIG. 18 (1800), the gun string assembly (1890) may be mechanically coupled to the wellbore setting tool at an upstream end (towards heel end) of the wellbore setting tool. The downstream end of the wellbore setting tool (1882) is mechanically coupled to the wellbore retrieval tool (1810). According to a preferred exemplary embodiment, the plug 1886 is configured with a shear ring that may be used to separate the wellbore retrieval tool 1810 from wellbore setting tool 1882 after setting the plug with the restriction element 1812. According to another preferred exemplary embodiment, the plug 1886 may be set by transmitting a setting force from wellbore setting tool 1882 through the wellbore retrieval tool 1810.

Preferred Exemplary Wellbore Stage Completion Method Flowchart

Figure 19:
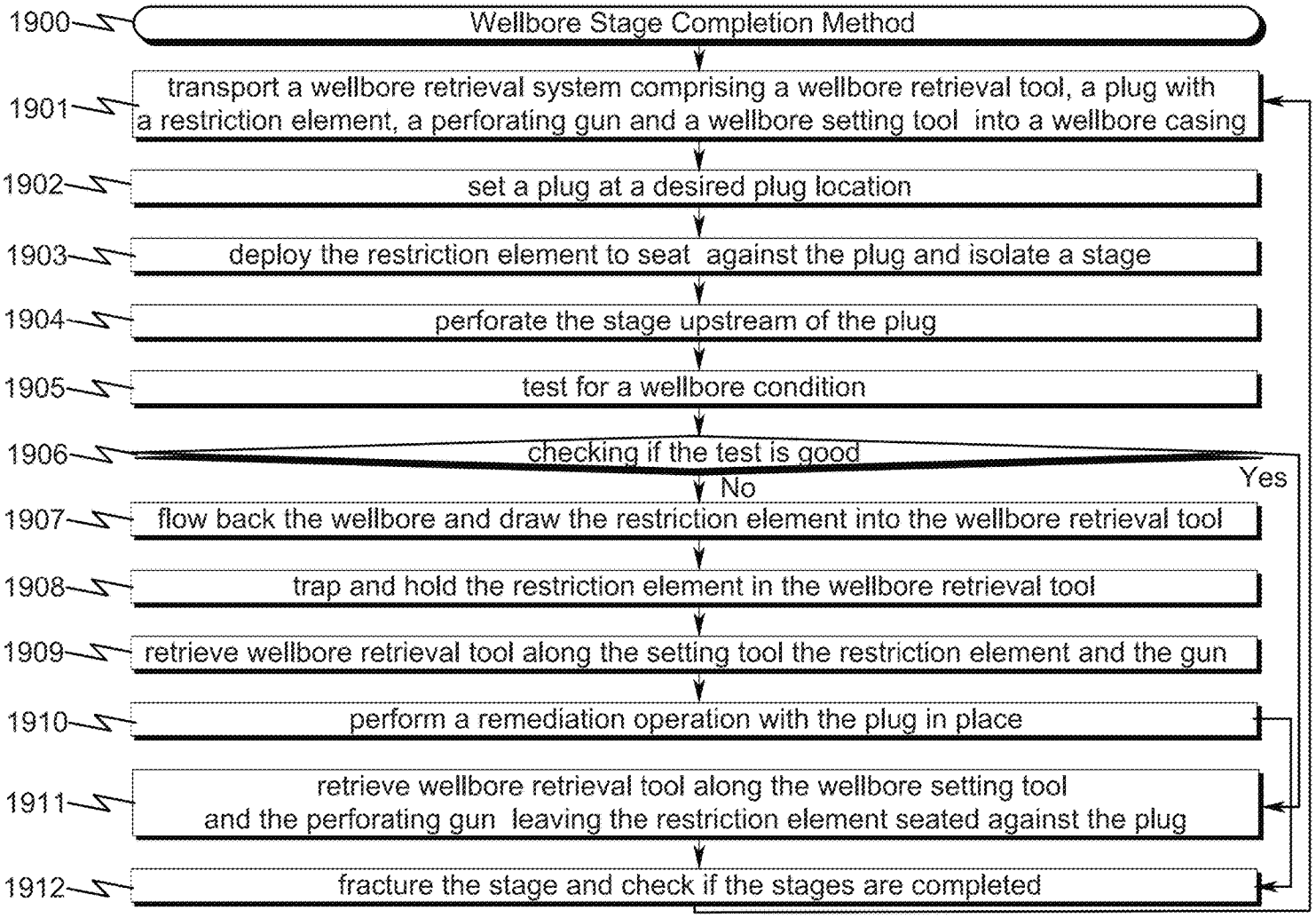
FIG. 19 illustrates a wellbore completion flow chart method for use in a wellbore casing according to an exemplary embodiment of the present invention.

As generally illustrated in FIG. 19 (1900), a preferred exemplary wellbore stage completion flow chart method in a wellbore casing with a wellbore completion system with a wellbore plugging system as illustrated in FIG. 18 (1800) may be generally described in terms of the following steps:

(1) transporting a wellbore retrieval system comprising a wellbore retrieval tool, a plug with a restriction element, a wellbore setting tool and a perforating gun string into the wellbore casing (1901);
tool strings may be run with perforating guns and a plug setter tool (wellbore setting tool) using ball-in-place plugs to save time and fluid usage. These tool strings may also incorporate a retrieval tool for immediate use if a situation arises where ball retrieval is desired. The restriction element may be any plugging element such a fracturing plug. The fracturing plug may be shaped circular, cylindrical or a dart. The perforating gun string may comprise one or more guns coupled together as a gun string assembly.

(2) setting a plug at a desired plug location (1902);
the plug may be set a desired location to isolate a stage that needs to be fractured.

(3) deploying the restriction element to seat against the plug and isolating a stage (1903);
the restriction element such as a fracturing ball may seat on the set plug. The setting of the plug as in step (2) and the deployment of the restriction element as in step (3) may be performed simultaneously. Alternatively, the setting of the plug as in step (2) may be performed prior to the deployment of the restriction element as in step (3). The plug may also be deployed after the stage is perforated as in step (4). The restriction element may be deployed by pumping fluid so that the restriction element seats against the plug. The plug may be configured for fluid communication downstream of the wellbore casing.

(4) perforating the stage upstream of the plug (1904);
the perforating gun or guns may perforate the stage with the fracturing ball in place and the retrieval tool positioned to retrieve the fracturing ball.

(5) testing for a wellbore condition (1905);
One test may be to check for proper injection. Another condition may be to check for improper firing of any gun in the gun string. Fluid may be pumped from the surface to check if the injection of the stage that was perforated is good. Alternatively checking if the perforating guns fired correctly and the perforated stage can be injected.

(6) checking if testing is good, proceeding to step (11) (1906);
the check may be performed by the pumped fluid in step (5).

(7) flowing back the wellbore so that the restriction element is drawn into the wellbore retrieval tool (1907);
if the injection in step (6) is bad due to a hydraulic lockout or other conditions, the casing may be flowed back so that the fracturing ball is trapped and held in the wellbore retrieval tool as shown in step (8).

(8) trapping and holding the fracturing ball in the wellbore retrieval tool (1908);

(9) retrieving the wellbore retrieval tool along with the restriction element, the wellbore setting tool and the perforating gun (1909);

(10) performing a remediation operation with the plug in place and proceeding to step (12) (1910);
a remediation operation such as pumping another restriction element may be performed. Alternatively, another perforating gun string may be pumped and the stage perforated again after dropping a restriction element. Any other remediation step necessary to establish injection and alleviate a hydraulic lockout condition may be performed.

(11) retrieving the wellbore retrieval tool along with the restriction element, the wellbore setting tool and the perforating gun (1911);

(12) fracturing the stage and proceeding to step (1) (1912).
A check may be performed to check if more stages need to be perforated and fractured before proceeding to step (1). If more there are no more stages to be perforated and fractured, then wellbore may be prepared for production.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

System Summary

The present exemplary system anticipates a wide variety of variations in the basic theme of a wellbore tool, but can be generalized as a wellbore retrieval tool for retrieving an object in a wellbore casing, comprising a tool body configured to be inserted into and transported along the wellbore casing; the tool sized and configured to trap and hold the object to be retrieved; wherein, when the object is retrieved from the wellbore casing, the tool is transported into the wellbore casing to a location proximal to the object such that the object is drawn into a trap in the tool body for retrieval.

This general system summary may be augmented by the various elements described herein to produce a wide variety of invention embodiments consistent with this overall design description.

Method Summary

The present exemplary method anticipates a wide variety of variations in the basic theme of implementation, but can be generalized as a wellbore object retrieval method for retrieving an object in a wellbore casing with a wellbore retrieval tool, the method comprising the steps of:

1) transporting the wellbore retrieval tool along the wellbore casing;
2) flowing back the wellbore casing so that the object flows backwards towards the wellbore retrieval tool;
3) trapping and holding the object in the wellbore retrieval tool; and
4) pulling the wellbore retrieval tool along with the object to a surface.

This general method summary may be augmented by the various elements described herein to produce a wide variety of invention embodiments consistent with this overall design description.

System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wherein the object is a fracturing ball.

An embodiment wherein the object is debris in the wellbore casing.

An embodiment wherein the wellbore casing is in a hydraulic lockout condition.

An embodiment wherein the tool is transported with a wireline.

An embodiment further comprising an adapter for connecting the tool body to the wireline.

An embodiment wherein the tool body is configured to allow fluid passage through the tool body.

An embodiment further comprising a screen within the tool body; the screen configured to receive the fracturing ball flowing into the tool body and limiting fluid passage through the tool body upon receipt of the fracturing ball.

An embodiment wherein the tool further comprises a channeling apparatus for directing the fracturing ball flowing into the tool body into a trap opening configured to allow passage of the fracturing ball through a trap inside the tool body.

An embodiment further comprising at least one trap fluid port configured to direct a trapped fracturing ball away from the trap opening for preventing escape of the fracturing ball.

An embodiment further comprising a guide for positioning the tool body within the wellbore casing.

An embodiment wherein the guide is configured to direct the fracturing ball towards a trap.

An embodiment wherein the fracturing ball is retrieved from a perforation plug.

An embodiment wherein the fracturing ball is retrieved from a ball-actuated sliding sleeve.

An embodiment wherein the wellbore casing is a horizontal wellbore casing.

An embodiment wherein the wellbore casing is a vertical wellbore casing.

An embodiment wherein the location is a heel end of the wellbore casing.

Wellbore Plugging System Summary

The present exemplary system anticipates a wide variety of variations in the basic theme of a wellbore plugging system, but can be generalized as a wellbore plugging system for use in a wellbore casing comprising: a wellbore setting tool, a wellbore retrieval tool and a ball-in-place plug; said wellbore retrieval tool operatively coupled to the wellbore setting tool on an upstream end of the wellbore retrieval tool; the wellbore retrieval tool operatively coupled to the ball-in-place plug on a downstream end of the wellbore retrieval tool; a restriction element is configured to be conveyed with the ball-in-place plug; the wellbore retrieval tool sized and configured to trap and hold the restriction element; wherein, the restriction element is drawn by well flow back into a trap in the wellbore retrieval tool for retrieval.

Wellbore Plugging Method Summary

The present exemplary method anticipates a wide variety of variations in the basic theme of implementation, but can be generalized as a wellbore plugging method for use in a wellbore casing with a wellbore plugging system comprising a wellbore setting tool, a wellbore retrieval tool and a ball-in-place plug, the method comprising the steps of:

1) transporting a wellbore retrieval tool, a plug, a fracturing ball, a wellbore setting tool and a perforating gun into the wellbore casing;
2) setting a plug at a desired plug location;
3) placing the fracturing ball against the plug and isolating a stage;
4) perforating the stage upstream of the plug;
5) testing injection of the stage that was perforated;
6) checking if injection is good, proceeding to step (11);
7) flowing back the wellbore casing so that the fracturing ball flows backwards towards the wellbore retrieval tool;
8) trapping and holding the fracturing ball in the wellbore retrieval tool;
9) pulling the wellbore retrieval tool along with the fracturing ball to a surface, skipping the stage and proceeding to step (1);
10) retrieving wellbore retrieval tool along the wellbore setting tool and the perforating gun
11) fracturing the stage and proceeding to step (1).

This general method summary may be augmented by the various elements described herein to produce a wide variety of invention embodiments consistent with this overall design description.

Wellbore Plugging System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wellbore retrieval tool is configured to allow passage of fluid.

An embodiment the plug is configured to be in fluid communication downstream of the ball-in-place plug.

An embodiment the restriction element is a fracturing ball.

An embodiment the plug is set by transmitting a force from the wellbore setting tool to the plug through the wellbore retrieval tool.

An embodiment the wellbore retrieval tool is armed to trap the restriction element when the ball-in-place plug is set.

An embodiment the restriction element is configured to be deployed to seat against the ball-in-place plug upon separation of the wellbore setting tool from the plug.

An embodiment the restriction element is configured to be deployed to seat against the ball-in-place plug by pumping fluids into the wellbore casing.

An embodiment the restriction element is a fracturing ball.

An embodiment setting the ball-in-place plug step (2) the and deploying the restriction element step (3) are performed simultaneously.

An embodiment deploying the restriction element step (3) is performed upon separation of the wellbore setting tool from the ball-in-place plug.

An embodiment the wellbore condition is a hydraulic lockout condition.

An embodiment the wellbore plugging system is transported with a wireline.

An embodiment the wellbore casing is a horizontal wellbore casing.

An embodiment the wellbore casing is a vertical wellbore casing.

Wellbore Completion System Summary

The present exemplary system anticipates a wide variety of variations in the basic theme of a wellbore completion system for use in a wellbore casing comprising: a wellbore setting tool, a wellbore retrieval tool, a ball-in-place plug and a perforating gun; the wellbore retrieval tool operatively coupled to the wellbore setting tool on an upstream end of the wellbore retrieval tool; the wellbore retrieval tool operatively coupled to the ball-in-place plug on a downstream end of the wellbore retrieval tool; the perforating gun is operatively coupled at an upstream end of the wellbore setting tool; a restriction element is configured to be conveyed with the ball-in-place plug; the wellbore retrieval tool sized and configured to trap and hold the restriction element; wherein, the restriction element is drawn by well flow back into a trap in the wellbore retrieval tool for retrieval.

Wellbore Completion Method Summary

The present exemplary method anticipates a wide variety of variations in the basic theme of implementation, but can be generalized as a wellbore completion method for use in a wellbore casing with a wellbore completion system comprising a perforating gun, wellbore setting tool, a wellbore retrieval tool and a ball-in-place plug, the method comprising the steps of:

1) transporting the wellbore plugging system along the wellbore casing;
2) setting the ball-in-place plug at a desired plug location;
3) deploying the restriction element to seat against the plug and isolating a stage;
4) perforating the stage with the perforating gun;
5) testing for a wellbore condition;
6) checking if the wellbore condition is good, if so, proceeding to step (11);
7) flowing back the wellbore so that the restriction element is drawn by well flow back into the wellbore retrieval tool;
8) trapping and holding the fracturing ball in the wellbore retrieval tool;
9) retrieving the wellbore retrieval tool along with the restriction element, the wellbore setting tool, and the perforating gun to a well surface;
10) performing a remediation operation with the ball-in-place plug in place and proceeding to step (12);
11) retrieving the wellbore retrieval tool along with the wellbore setting tool and perforating gun and leaving the restriction element seated against the ball-in-place plug; and
12) fracturing the stage and proceeding to step (1).

This general method summary may be augmented by the various elements described herein to produce a wide variety of invention embodiments consistent with this overall design description.

I claim:

1. A wellbore retrieval tool for retrieving an object in a wellbore casing, comprising a tool body configured to be inserted into and transported along said wellbore casing; said tool sized and configured to trap and hold said object to be retrieved within said tool;

wherein, when said object is retrieved from said wellbore casing, said tool is transported into said wellbore casing to a location proximal to said object such that said object is drawn by well flow back into a trap in said tool body for retrieval.

2. The wellbore retrieval tool of claim 1, wherein said object is a fracturing ball.

3. The wellbore retrieval tool of claim 2, wherein said fracturing ball is retrieved from a perforation plug.

4. The wellbore retrieval tool of claim 2, wherein the fracturing ball is retrieved from a ball-actuated sliding sleeve.

5. The wellbore retrieval tool of claim 1, wherein said object is debris in said wellbore casing.

6. The wellbore retrieval tool of claim 1, wherein said tool is transported with a wireline.

7. The wellbore retrieval tool of claim 1, wherein the tool body is configured to allow fluid passage through said tool body.

8. The wellbore retrieval tool of claim 1, further comprising a screen within said tool body; said screen configured to receive said object flowing into said tool body and limiting fluid passage through said tool body upon receipt of said object.

9. The wellbore retrieval tool of claim 1, wherein said tool further comprises a channeling apparatus for directing said object flowing into said tool body into a trap opening configured to allow passage of said object through said trap inside said tool body.

10. The wellbore retrieval tool of claim 9, further comprising at least one trap fluid port configured to direct a trapped object away from said trap opening for preventing escape of said object.

11. The wellbore retrieval tool of claim 1, further comprising a guide for positioning said tool body within said wellbore casing.

12. The wellbore retrieval tool of claim 11, wherein said guide is configured to direct said object towards said trap.

13. The wellbore retrieval tool of claim 1, wherein said wellbore casing is a vertical wellbore casing.

14. The wellbore retrieval tool of claim 1, wherein said wellbore casing is a horizontal wellbore casing.

15. The wellbore retrieval tool of claim 14, wherein said location is a heel end of said wellbore casing.

16. A wellbore object retrieval method for retrieving an object in a wellbore casing with a wellbore retrieval tool, said method comprising the steps of:

1) transporting said wellbore retrieval tool along said wellbore casing;
2) flowing back wellbore so that said object is drawn into said wellbore retrieval tool;
3) trapping and holding said object in said wellbore retrieval tool; and
4) pulling said wellbore retrieval tool along with said object to a surface.

17. The wellbore object retrieval method of claim 16, wherein said object is a fracturing ball.

18. The wellbore object retrieval method of claim 17, wherein said fracturing ball is retrieved from a perforation plug.

19. The wellbore object retrieval method of claim 17, wherein said fracturing ball is retrieved from a ball-actuated sliding sleeve.

20. The wellbore object retrieval method of claim 16, wherein said object is debris in said wellbore casing.

21. The wellbore object retrieval method of claim 16, wherein said wellbore casing is in a hydraulic lockout condition.

22. The wellbore object retrieval method of claim 16, wherein said tool is transported with a wireline.

23. The wellbore object retrieval method of claim 16, wherein said tool is transported with a rigid tubing.

24. The wellbore object retrieval method of claim 16, wherein said tool is transported with a coiled tubing.

25. The wellbore object retrieval method of claim 16, wherein said wellbore casing is a horizontal wellbore casing.

26. The wellbore object retrieval method of claim 25, wherein said location is a heel end of said wellbore casing.

27. The wellbore object retrieval method of claim 16, wherein said wellbore casing is a vertical wellbore casing.

28. A wellbore object retrieval method with a wellbore retrieval tool for retrieving a plurality of fracturing balls from sliding sleeves in a wellbore casing, said method comprising the steps of:

1) transporting said wellbore retrieval tool along said wellbore casing;
2) flowing back wellbore so that said fracturing balls are drawn into said wellbore retrieval tool;
3) trapping and holding said fracturing balls in said wellbore retrieval tool; and
4) pulling said wellbore retrieval tool along with said fracturing balls to a surface.

29. A wellbore retrieval tool for retrieving an object in a wellbore casing, comprising a tool body configured to be inserted into and transported along said wellbore casing, a spring tension arm housed within said tool body, and a trap opening;

wherein, when said object is to retrieved from said wellbore casing, said tool is transported into said wellbore casing to a location proximal to said object such that said object is drawn by well flow back and said object depresses said spring tension arm to allow said object to enter said trap opening and said spring tension arm springs back to prevent escape of said object.

* * * * *